US011633949B2

(12) United States Patent
Martin et al.

(10) Patent No.: US 11,633,949 B2
(45) Date of Patent: Apr. 25, 2023

(54) FLUID ACTUATORS CONNECTED TO FIELD EFFECT TRANSISTORS

(71) Applicant: Hewlett-Packard Development Company, L.P., Spring, TX (US)

(72) Inventors: Eric Martin, Corvallis, OR (US); James R Przybyla, Corvallis, OR (US); Rogelio Cicili, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 71 days.

(21) Appl. No.: 16/973,999

(22) PCT Filed: Sep. 24, 2018

(86) PCT No.: PCT/US2018/052431

§ 371 (c)(1),
(2) Date: Dec. 10, 2020

(87) PCT Pub. No.: WO2020/068032

PCT Pub. Date: Apr. 2, 2020

(65) Prior Publication Data

US 2021/0206161 A1 Jul. 8, 2021

(51) Int. Cl.
*B41J 2/045* (2006.01)
*B41J 2/14* (2006.01)

(52) U.S. Cl.
CPC ..... *B41J 2/0455* (2013.01); *B41J 2/04581* (2013.01); *B41J 2/14072* (2013.01); *B41J 2/14201* (2013.01); *B41J 2002/14491* (2013.01)

(58) Field of Classification Search
CPC .. B41J 2/0455; B41J 2/04581; B41J 2/14072; B41J 2/14201; B41J 2/0458
See application file for complete search history.

(56) References Cited

U.S. PATENT DOCUMENTS

| | | | |
|---|---|---|---|
| 6,371,596 | B1 | 4/2002 | Maze et al. |
| 6,402,279 | B1 | 6/2002 | Torgerson et al. |
| 6,491,377 | B1 | 12/2002 | Cleland et al. |
| 7,604,321 | B2 | 10/2009 | Sheahan et al. |
| 2004/0080578 | A1 | 4/2004 | Dunfield et al. |
| 2004/0125157 | A1 | 7/2004 | Edelen et al. |
| 2008/0013974 | A1 | 1/2008 | Im et al. |

(Continued)

FOREIGN PATENT DOCUMENTS

| | | | |
|---|---|---|---|
| CN | 1367080 | A | 9/2002 |
| CN | 101104333 | A | 1/2008 |

(Continued)

*Primary Examiner* — Scott A Richmond
(74) *Attorney, Agent, or Firm* — Foley & Lardner LLP

(57) ABSTRACT

Examples include a fluidic die. The fluidic die comprises an array of field effect transistors. Connecting members electrically connect at least some of the field effect transistors of the array of field effect transistors, and the field effect transistors of the array are arranged into respective sets of field effect transistors. The fluidic die further comprises a first fluid actuator connected to a first set of field effect transistors having a first number of field effect transistors. The die includes a second fluid actuator connected to a second respective set of field effect transistors having a second number of field effect transistors that is different than the first number of field effect transistors.

20 Claims, 17 Drawing Sheets

(56) References Cited

U.S. PATENT DOCUMENTS

| | | | | |
|---|---|---|---|---|
| 2013/0010033 | A1 | 1/2013 | Endo et al. | |
| 2014/0232791 | A1* | 8/2014 | Gardner | B41J 2/04541 347/54 |
| 2016/0059560 | A1 | 3/2016 | Edelen et al. | |
| 2019/0329566 | A1* | 10/2019 | Clark | B41J 2/14201 |
| 2020/0122458 | A1* | 4/2020 | McClelland | B41J 2/0458 |

FOREIGN PATENT DOCUMENTS

| | | | |
|---|---|---|---|
| CN | 102862389 | A | 1/2013 |
| CN | 103677032 | A | 3/2014 |
| CN | 103857530 | A | 6/2014 |
| CN | 106647086 | A | 5/2017 |
| EP | 1710084 | | 10/2008 |
| TW | 200408544 | A | 6/2004 |
| WO | WO-2013055356 | | 4/2013 |
| WO | 2018/067141 | A1 | 4/2018 |

* cited by examiner

FLUID ACTUATORS CONNECTED TO FIELD EFFECT TRANSISTORS

BACKGROUND

Fluidic dies may process small volumes of fluid. For example, nozzles of fluidic dies may facilitate ejection of fluid drops. In some fluidic dies, various electrical components may be used to analyze, convey, and/or perform other such processes for fluid of the fluidic die. Accordingly, various arrangements of electrical components may be implemented in fluidic dies to enable and control performance of such processes. Some example fluidic dies may be fluid ejection dies, where the fluid drops may be controllably ejected via nozzles of the fluid ejection die.

DRAWINGS

Figure 15A:
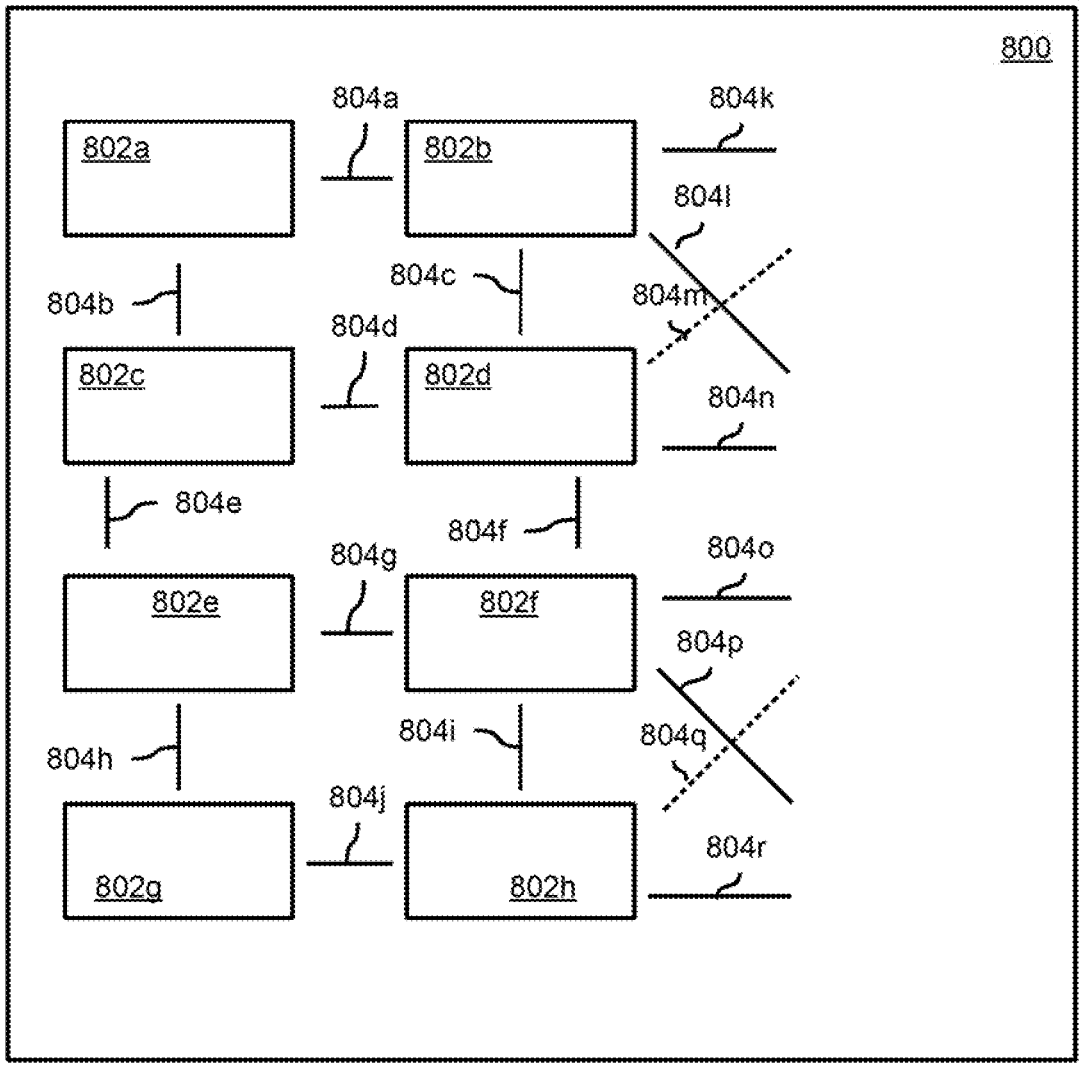
Figure 15B:
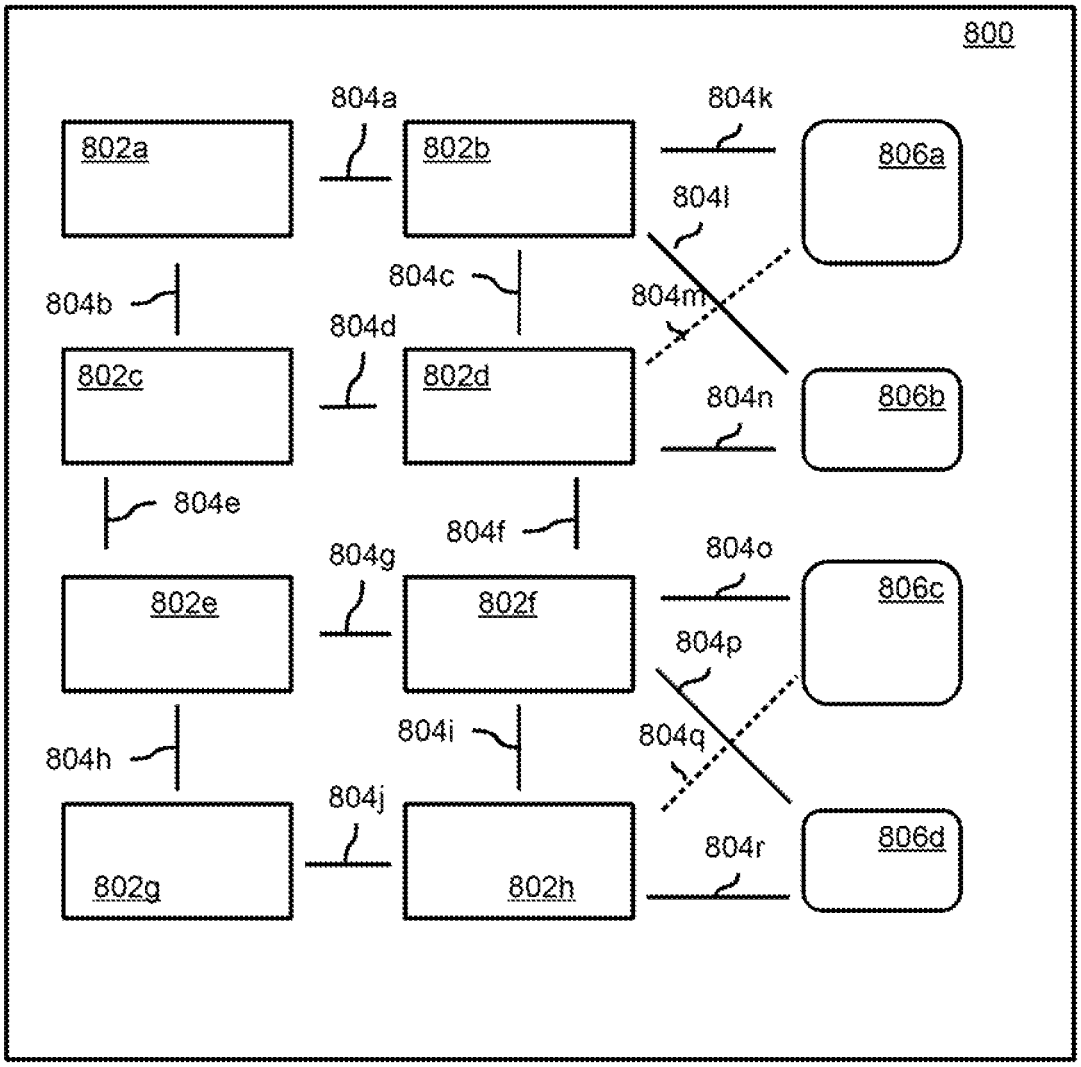
Figure 15C:
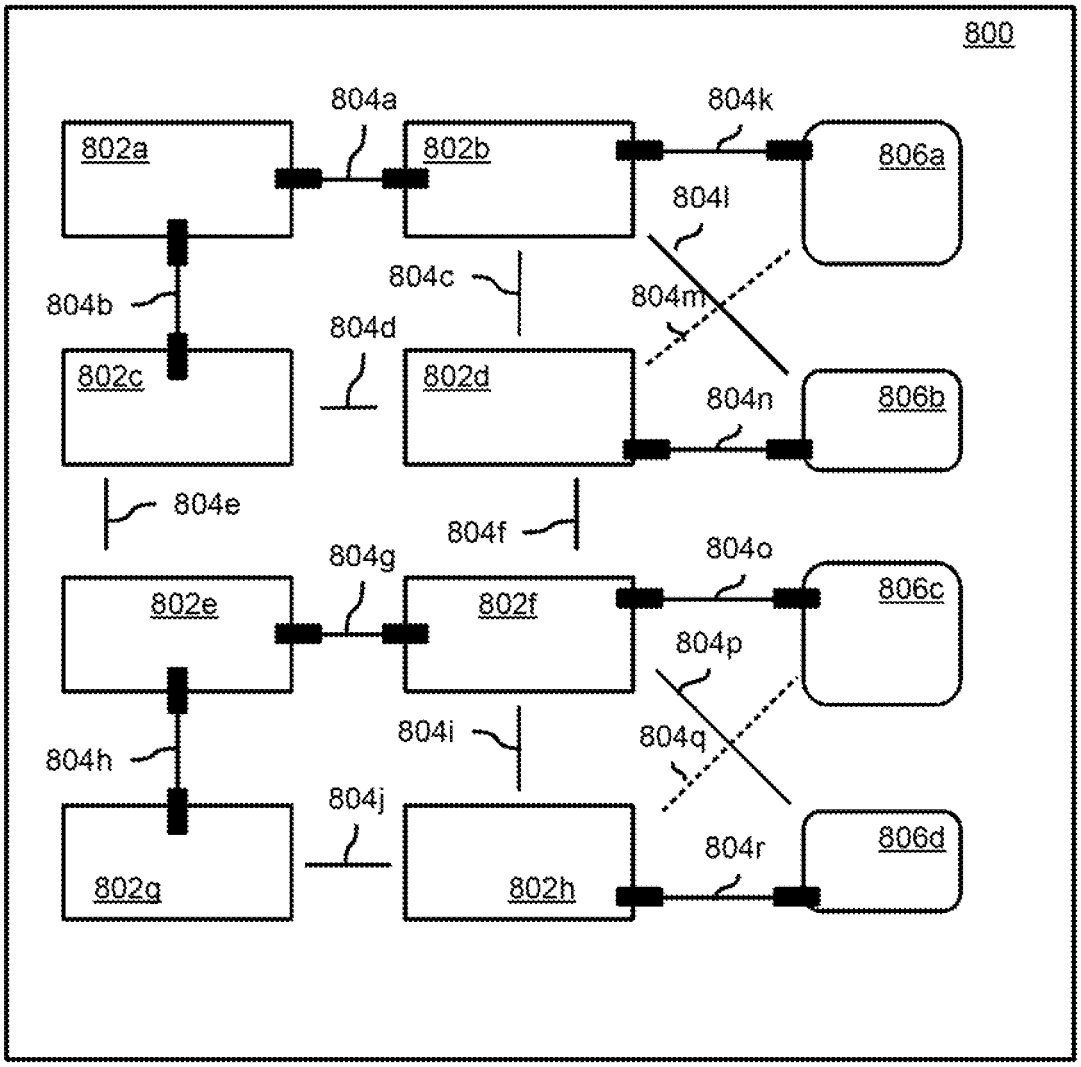

FIGS. 15A-C are block diagrams that illustrate an example process.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DESCRIPTION

Examples of fluidic dies may comprise fluid actuators. The fluid actuators may include a piezoelectric membrane-based actuator, a thermal resistor-based actuator, an electrostatic membrane actuator, a mechanical/impact driven membrane actuator, a magneto-strictive drive actuator, or other such elements that may cause displacement of fluid responsive to electrical actuation. To control actuation of such fluid actuators, examples may further include field effect transistors (FETs) which may be connected to the fluid actuators. Accordingly, electrical control of the connected FETs may enable selective control of fluid actuators of the fluidic die.

Fluidic dies, as used herein, may correspond to a variety of types of integrated devices with which small volumes (e.g., picoliter volumes, nanoliter volumes, microliter volumes, etc.) of fluid may be pumped, mixed, analyzed, ejected, etc. Such fluidic dies may include fluid ejection dies, such as printheads, additive manufacturing distributor components, digital titration components, and/or other such devices with which volumes of fluid may be selectively and controllably ejected. Other examples of fluidic dies include fluid sensor devices, lab-on-a-chip devices, and/or other such devices in which fluids may be analyzed and/or processed.

In some example fluidic dies, a fluid actuator may be disposed in a fluid chamber, where the fluid chamber may be fluidically coupled to a nozzle. In some examples, a fluid chamber may be referred to as a "pressure chamber." The fluid actuator may be actuated such that displacement of fluid in the fluid chamber occurs and such displacement may cause ejection of a fluid drop via an orifice of the nozzle. Accordingly, a fluid actuator disposed in a fluid chamber that is fluidically coupled to a nozzle may be referred to as a "fluid ejector." Moreover, the fluidic component comprising the fluid actuator, fluid chamber, and nozzle may be referred to as a "drop generator."

Example fluidic dies described herein may comprise microfluidic channels in which fluidic actuators may be disposed. In such implementations, actuation of a fluid actuator disposed in a microfluidic channel may generate fluid displacement in the microfluidic channel. Accordingly, a fluid actuator disposed in a microfluidic channel may be referred to as a "fluid pump." The distinction between implementations of a fluid actuator is an example of different fluid actuator types. For example, a fluid actuator implemented as a fluid ejector may be considered a different fluid actuator type as compared to a fluid actuator implemented as a fluid pump.

Microfluidic features, such as microfluidic channels or fluid chambers may be formed by performing etching, microfabrication (e.g., photolithography), deposition, micromachining processes, or any combination thereof in or on a substrate of a fluidic die. Some example substrates may include silicon-based substrates, glass-based substrates, gallium arsenide-based substrates, and/or other such suitable types of substrates for microfabricated devices and structures. Accordingly, microfluidic channels, chambers, nozzles, orifices, and/or other such features may be defined by surfaces fabricated in the substrate and/or materials deposited on the substrate of a fluidic die. Furthermore, as used herein a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.).

Due to the various arrangements and configurations of fluid actuators that may be implemented in an example fluidic die, electrical constraints and demands of such fluid actuators and the control logic connected to such fluid actuators may be different for fluid actuators of a fluidic die. Accordingly, electrical characteristics of FETs connected to fluid actuators of a fluidic die may be different, where the electrical characteristics of the connected FETs may be based at least in part on operating parameters of fluid actuators to which the FETs may be connected. As used herein, operating parameters of fluid actuators may include, for example, current, voltage, and/or power levels at which a fluid actuator may be operated to perform fluid displacement. In some fluidic dies, the FETs and associated logic connected to each fluid actuator may be designed to the specification of the fluid actuators of the fluidic die. However, in some cases, a substrate including the FETs and associated logic may be used in more than one fluidic die design, where operating parameters of fluid actuators of the fluidic die designs may be different.

Accordingly, fluidic die processing efficiency may be increased by using substrates having flexible arrangements of field effect transistors formed thereon. During forming and processing of the substrates to form fluidic channels, chambers, fluid actuators, nozzles and/or other components, flexible field effect transistor arrangements may be set to the design specifications of the fluidic die in which the substrate may be implemented. For example, interconnect layers may be configured for arrangements of FETs to deliver optimal energy to various different types of fluid actuators. Configuring of such interconnect layers may include connecting some connecting members to interconnect some FETs as well as to connect FETs to fluid actuators.

Examples provided herein may include fluidic dies and processes for generating fluidic dies in which configurations of field effect transistors may be set when forming the fluidic features and components of the fluidic die. An example fluidic die may comprise an array of field effect transistors, and the die may further include connecting members that interconnect some of the field effect transistors of the array. As used herein, connecting members may include jumper(s), conductive trace(s), and/or other such electrical connecting components. For example, a connecting member may comprise at least one conductive trace. As another example, a connecting member may comprise at least two conductive traces. Moreover, as used herein, interconnected field effect transistors may include field effect transistors having connected gates, sources, and drains. Therefore, as used herein, connecting members may connect gates, sources, and/or drains between field effect transistors such that the field effect transistors may operate in parallel. As a particular example, a connecting member that connects two field effect transistors may include a first conductive trace that connects sources of the field effect transistors and a second conductive trace that connects gates of the field effect transistors. In this example, drains of the two field effect transistors may be commonly connected to a voltage supply. Furthermore, connecting members may connect field effect transistor sets to fluid actuators. Arrangements of field effect transistors connected to a fluid actuator may be referred to as sets of field effect transistors. In such examples, the sets of field effect transistors may include different arrangements and numbers of field effect transistors based at least in part on operating parameters of fluid actuators to which the sets of field effect transistors may be connected.

For example, a first fluid actuator of an example fluidic die may be connected to a set of field effect transistors having a first number of field effect transistors, and a second fluid actuator of an example fluidic die may be connected to a set of field effect transistors having a second number of field effect transistors. In some examples the first number of field effect transistors and the second number of field effect transistors may be different. For example, a first fluid actuator of the fluidic die may be connected to a first set of field effect transistors including at least two interconnected field effect transistors, and a second fluid actuator may be connected to a second set of field effect transistors having a greater number of interconnected field effect transistors. As another example, a first fluid actuator may be connected to a respective set of FETs including a single FET, and a second fluid actuator may be connected to a respective set of FETs including at least two FETs.

Figure 1:
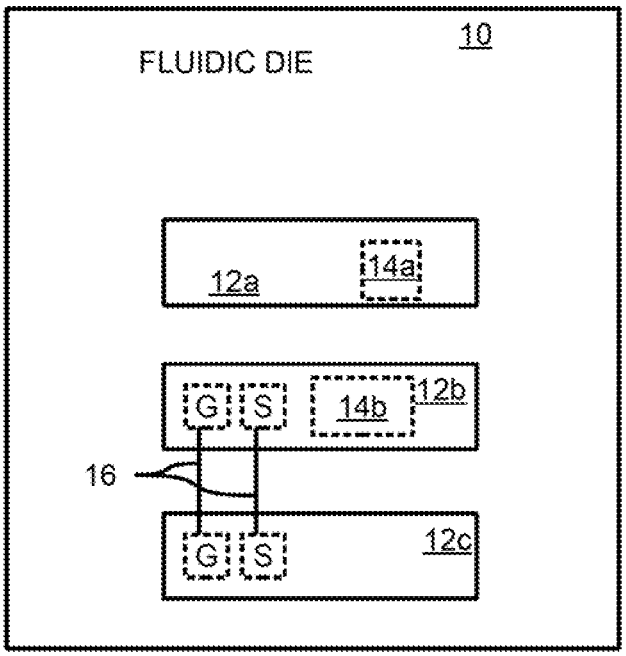
FIG. 1 is a block diagram that illustrates some components of an example fluidic die.

Turning now to the figures, and particularly to FIG. 1, this figure provides a block diagram of an example fluidic die 10. The fluidic die 10 includes an array of field effect transistors 12*a-c*. Furthermore, the fluidic die includes fluid actuators 14*a-b*. A first fluid actuator 12*a* of the fluidic die 10 is connected to a set of field effect transistors, that, in this example, includes a first field effect transistor 12*a*. Furthermore, the fluidic die 10 further includes a connecting member 16 that interconnects a second field effect transistor 12*b* and a third field effect transistor 12*c* of the array such that the second field effect transistor 12*b* and the third field effect transistor 12*c* form a second set of field effect transistors 12*b-c*. In this example, the second set of field effect transistors 12*b-c* may be connected to a second fluid actuator 14*b*. Accordingly, in this example, the first fluid actuator 14*a* is connected to the first set of field effect transistors 12*a* that includes only the first field effect transistor 12*a*. The second fluid actuator 14*b* is connected to the set of field effect transistors having two field effect transistors—i.e., the second field effect transistor 12*b* and the third field effect transistor 12*c* that are interconnected by the connecting member 16. Hence, the number of field effect transistors in the first set connected to the first fluid actuator 14*a* is different than the number of field effect transistors in the second set 12*b-c* connected to the second fluid actuator 14*b*.

As may be noted, the connecting member 16 connects a respective gate (labeled 'G') of the second field effect transistor 12*b* and a gate of the third field effect transistor 12*c*, and the connecting member further connects a source (labeled 'S') of the second field effect transistor 12*b* and a source of the third field effect transistor 12*c*. Accordingly, as used herein, a connecting member that interconnects at least two field effect transistors may include electrical connections between sources, gates, and/or drains of the field effect transistors.

Figure 2:
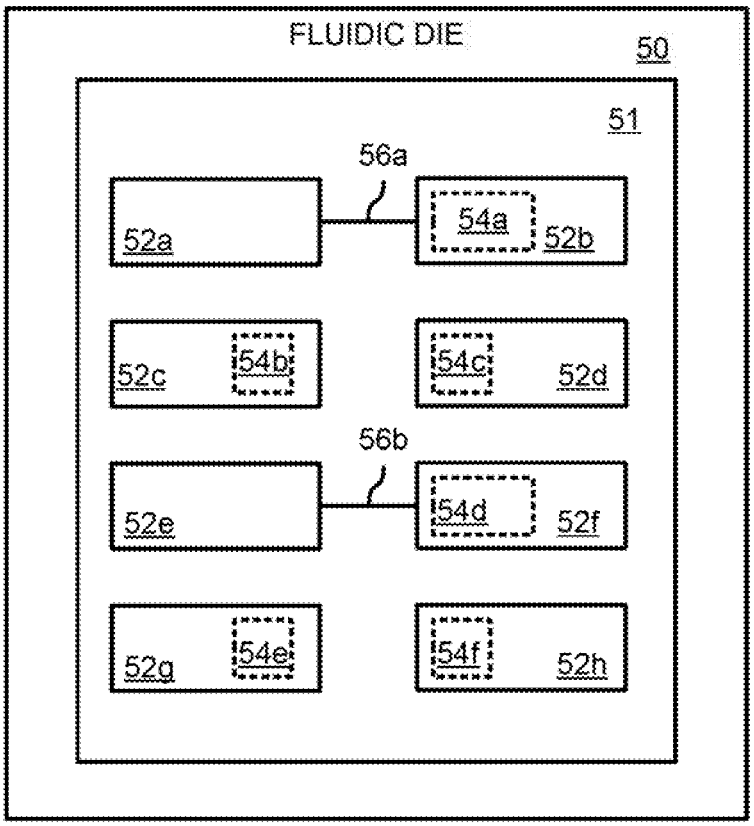
FIG. 2 is a block diagram that illustrates some components of an example fluidic die.

In FIG. 2, some components of an example fluidic die 50 are provided in a block diagram. In this example, the fluidic die 50 includes an array 51 of field effect transistors 52*a-h* and a plurality of fluid actuators 54*a-f*. Moreover, the fluidic die 50 includes connecting members 56*a-b*. In this example, a first connecting member 56*a* interconnects a first field effect transistor 52*a* and a second field effect transistor 52*b*, and the set of field effect transistors 52*a-b* formed thereby is connected to a first fluid actuator 54*a*. A third field effect transistor 52*c*, which is not connected to other field effect transistors, and, accordingly, may be considered a set of field effect transistors having a single field effect transistor, is connected to a second fluid actuator 54*b*. Similarly, a fourth field effect transistor 52*d* is connected to a third fluid actuator 54*c*. A fifth field effect transistor 52*e* and a sixth field effect transistor 52*f* are interconnected via a second connecting member 56*b* to thereby form a set of field effect transistors 52*e-f* including two interconnected field effect transistors. The set of field effect transistors including the fifth field effect transistor 52*e* and the sixth field effect transistor 52*f* is connected to a fourth fluid actuator 54*d*. In addition, as shown, the die 50 further includes a seventh field effect transistor 52*g* connected to a fifth fluid actuator 54*e*, and the die 50 includes an eighth field effect transistor 52*h* connected to a sixth fluid actuator 54*f*.

Accordingly, in this example, different fluid actuators 54*a-f* of the fluidic die 50 may be connected to different numbers of interconnected field effect transistors 52*a-h*. Moreover, as may be noted in this example, the first fluid actuator 54*a* and the fourth fluid actuator 54*d* may correspond to a first actuator size, and the second fluid actuator 54*b*, third fluid actuator 54*c*, fifth fluid actuator 54*e*, and sixth fluid actuator 54*f* may correspond to a second fluid actuator size that is different than the first fluid actuator size. Due to the differences in fluid actuator sizes, the fluid actuators may have different operating parameters. Accordingly, the number of field effect transistors 52*a-h* connected to each fluid actuator 54*a-f* may be based at least in part on the fluid actuator size. In this example, the first fluid actuator size may be greater than the second fluid actuator size. Consequently, the first fluid actuator 54*a* and fourth fluid actuator 54*d* may be connected to sets of field effect transistors having at least two interconnected field effect transistors. As used herein, a fluid actuator size may correspond to a surface area of the fluid actuator. For example, in a thermal resistor-based fluid actuator, the fluid actuator size may correspond to the thermal resistor surface area. In a piezoelectric membrane-based fluid actuator, the fluid actuator size may correspond to a surface area of the flexible membrane.

Moreover, in this example, it may be noted that the first sized fluid actuators may be a first type of fluid actuator, and the second sized fluid actuators may be a second type of fluid actuator. The fluid actuators of the first type may correspond to a first fluid drop size, and the fluid actuators of the second type may correspond to a second fluid drop size. Examples similar to the examples described herein may include fluid actuators corresponding to different fluid drop sizes. In this example, the first fluid drop size may be greater than the second fluid drop size. As used herein, fluid drop size refers to a drop volume and/or a drop mass of a fluid drop ejected via a nozzle due to actuation of a fluid actuator.

Therefore, as shown in FIG. 2, in this example, the fluidic die 50 includes an array 51 of field effect transistors 52*a-h* and a plurality of connecting members 56*a-b*. The connecting members 56*a-b* include respective connecting members that interconnect some field effect transistors of the array 51, such as the first field effect transistor 52*a* and the second field effect transistor 52*b*. The die 50 further includes a plurality of fluid actuators 54*a-f*. In this example, the plurality of fluid actuators includes fluid actuators of a first type, such as the second fluid actuator 54*b*, the third fluid actuator 54*c*, the fifth fluid actuator 54*e*, and the sixth fluid actuator 54*f*. The plurality of fluid actuators further comprises a second type of fluid actuator, such as the first fluid actuator 54*a* and the fourth fluid actuator 54*d*. As shown, each fluid actuator of the first type 54*b-c*, 54*e-f* is connected to a respective first set of field effect transistors—i.e., each fluid actuator of the first type 54*b-c*, 54*e-f* is connected to a set of field effect transistors having at least one field effect transistor. Each fluid actuator of the second type 54*a*, 54*d* is connected to a respective second set of field effect transistors—i.e., each fluid actuator of the second type 54*a*, 54*d* is connected to a set of field effect transistors having at least one more field effect transistor than the respective first sets of field effect transistors. In this example, each respective first set includes a single field effect transistor, and each respective second set includes two field effect transistors. However, it may be appreciated that other arrangements and numbers of field effect transistors may be implemented in other examples. For example, each respective first set of field effect transistors may include at least two field effect transistors, and each respective second set of field effect transistors may include at least three field effect transistors. Other variations may be implemented in other examples.

Furthermore, while not explicitly shown in this example, it may be appreciated that field effect transistors described as interconnected may have gates and sources thereof connected together, and the drains of the interconnected field effect transistors may be connected to a common voltage supply. Accordingly, interconnected field effect transistors may operate in parallel. Therefore, while the connecting members 56*a-b* of FIG. 2 (and other block diagrams described below) only illustrate single elements connecting the FETs, these single element connections are merely for illustrative purposes. Hence implementations corresponding to such example diagrams may include sets of wires, jumpers, conductive traces, etc. that facilitate connecting gates, sources, and/or drains together such that the interconnected field effect transistors operate in parallel.

Figure 3:
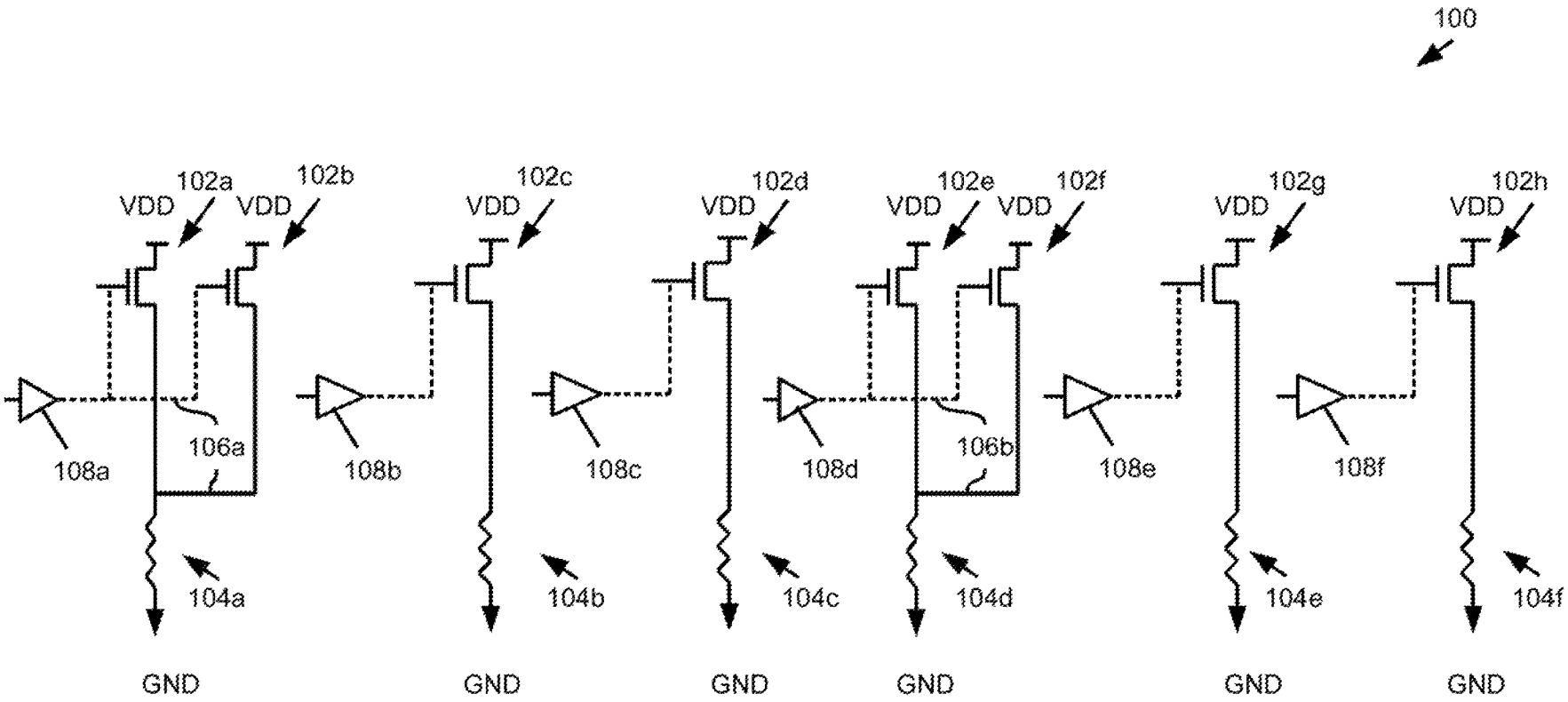
FIG. 3 is a logic diagram that illustrates some components of an example fluidic die.

FIG. 3 provides a logic diagram of some components pf an example fluidic die 100. In this example, the fluidic die 100 includes an array of field effect transistors 102*a-h*, and the die 100 includes fluid actuators 104*a-f*. As shown, a drain of each field effect transistor 102*a-h* is connected to a common voltage supply (labeled 'VPP'), and a source of each FET 102*a-h* is connected to ground (labeled 'GND') through a fluid actuator 104*a-f*.

As shown, a first connecting member 106*a* interconnects a first field effect transistor 102*a* and a second field effect transistor 102*b*. In particular, as shown, the drain of the first field effect transistor 102*a* and the drain of the second field effect transistor 102*b* are connected to a common voltage supply (labeled 'VPP'). A respective gate and respective source of each of the first and second field effect transistors 102*a-b* are connected. Accordingly, the interconnected first and second field effect transistors 102*a-b* may operate in parallel. A first fluid actuator 104*a* is connected to a respective set of field effect transistors that includes the first field effect transistor 102*a* and the second field effect transistor 102*b*. A second fluid actuator 104*b* is connected to a second respective set of field effect transistors that includes a third field effect transistor 102*c*. A third fluid actuator 104*c* is connected to a third respective set of field effect transistors that includes the fourth field effect transistor 102*d*.

A second connecting member 106*b* interconnects a fifth field effect transistor 102*e* and a sixth field effect transistor 102*f*. As shown, the drains of the fifth and sixth field effect transistors 102*e-f* are coupled to the common voltage supply VPP. Gates and sources of the fifth and sixth field effect transistors 102*e-f* are connected. Accordingly, the fifth and sixth field effect transistors operate in parallel. A fourth fluid actuator 104*d* is connected to a fourth respective set of field effect transistors that includes the fifth field effect transistor 102*e* and the sixth field effect transistor 102*f*. A fifth fluid actuator 104*e* is connected to a fifth respective set of field effect transistors that includes the seventh field effect transistor 102*g*. A sixth fluid actuator 104*f* is connected to a sixth respective set of field effect transistors that includes the eighth field effect transistor 102*h*.

In this example, a drain of each field effect transistor 102*a-h* may be coupled to a common voltage source. Respective gate drive logic 108*a-f* is coupled to the respective gate of each field effect transistor 102*a-h*. Notably, a respective gate drive logic 108*a-f* is coupled to the gates of each field effect transistor 102*a-h* of each respective set of field effect transistors. For example, a first gate drive logic 108*a* is connected to a gate of the first field effect transistor 102*a*, and the first gate drive logic 108*a* is connected to a gate of the second field effect transistor 102*b*. Accordingly, addressing the first gate drive logic 108*a* enables the gate of the first field effect transistor 102*a* and the second field effect transistor 102*b*, which, in turn, actuates the first fluid actuator 104*a*. As another example, addressing the second gate logic 108*b* enables the gate of the third field effect transistor 102*c*, which, in turn actuates the second fluid actuator 104*b*.

Accordingly, in this example, the first fluid actuator 104*a* and the fourth fluid actuator 104*d* may correspond to a first type of fluid actuator, and the second fluid actuator 104*b*, third fluid actuator 104*c*, fifth fluid actuator 104*e*, and sixth fluid actuator 104*f* may correspond to a second type of fluid actuator. In some examples, a type of a fluid actuator may correspond to a fluid actuator size, an actuation type (e.g., thermal resistor actuation, piezoelectric membrane actuation, etc.), and/or an implementation (e.g., a fluid pump, a fluid ejector). The first type of fluid actuators (i.e., the first fluid actuator 104*a* and the fourth fluid actuator) 104*d* may be driven by two interconnected field effect transistors driven in parallel. Accordingly, the first fluid actuator 104*a* and fourth fluid actuator 104*d* may have different operating parameters than the fluid actuators of the second type of fluid actuators 104*b*, 104*c*, 104*e*, 104*f*. Consequently, the respective sets of interconnected field effect transistors connected to the first fluid actuator 102*a* and the fourth fluid actuator 104*d* may correspond to the operating parameters of the first type of fluid actuator. Furthermore, in this example, the fluid actuators of the second type (i.e., the second fluid actuator 104*b*, the third fluid actuator 104*c*, the fifth fluid actuator 104*e*, and the sixth fluid actuator 104*f*) may be connected to respective sets of field effect transistors having one field effect transistor per set. Therefore, in this example, the operating parameters (and therefore electrical operating conditions for the connected field effect transistors) of the fluid actuators corresponding to the second type of fluid actuators 104*b*, 104*c*, 104*e*, 104*f* may correspond to a single field effect transistor. As a particular example, the fluid actuators of the first type may correspond to fluid ejectors, and the fluid actuators of the second type may correspond to fluid pumps. As another example, the fluid actuators of the first type may correspond to a first fluid drop size, and the fluid actuators of the second type may correspond to a second fluid drop size that may be less than the first fluid drop size.

Figure 4:
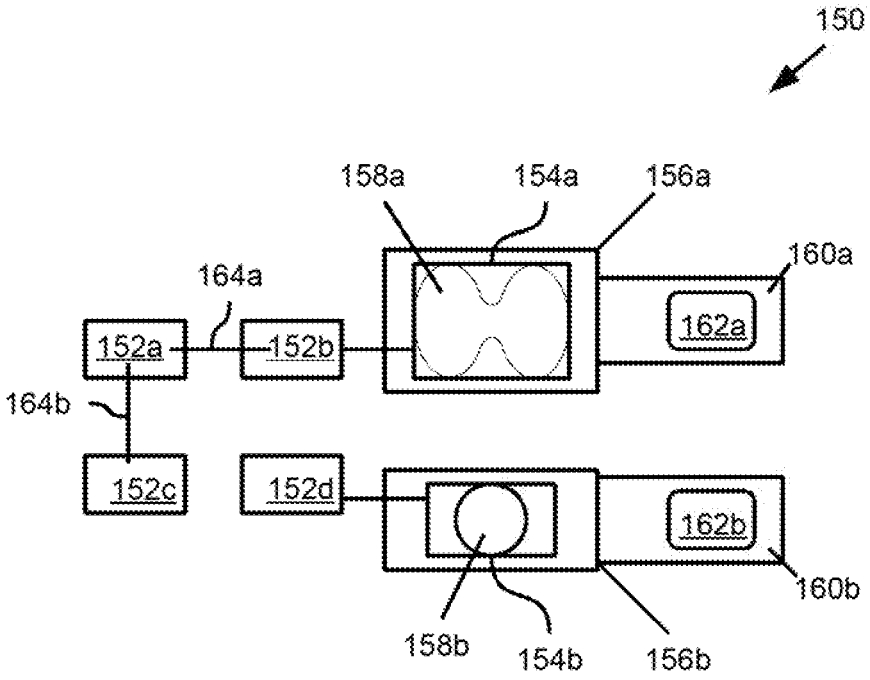
FIG. 4 is a block diagram that illustrates some components of an example fluidic die.

Turning now to FIG. 4, this figure provides a block diagram that illustrates some components of an example fluidic die 150. In this example, the fluidic die 150 comprises an array of field effect transistors 152*a-d*. The die 150 further includes fluid actuators 154*a-b*. In this example, each fluid actuator 154*a-b* is disposed in a respective fluid chamber 156*a-b*. Furthermore, each respective fluid chamber 156*a-b* is fluidically coupled to a respective nozzle 158*a-b*, and each respective fluid chamber 156*a-b* is fluidically coupled to a respective microfluidic channel 160*a-b* through which fluid may flow to the respective fluid chamber 156*a-b*. In this example, each microfluidic channel 160*a-b* includes a respective fluid supply passage 162*a-b* that may be fluidically coupled to a fluid supply channel, fluid supply slot, or other larger volume fluid reservoir. In some examples, microfluidic channels 160*a-b* of the fluid chambers 156*a-b* may be connected to a common fluid supply slot.

In this example, connecting members 164*a-b* interconnect a first field effect transistor 152*a*, a second field effect transistor 154*b*, and a third field effect transistor 152*c* such that these field effect transistors 152*a-c* form a first set of field effect transistors 152*a-c* including three interconnected field effect transistors. The first set of field effect transistors 152*a-c* are connected in parallel to a first fluid actuator 154*a*. Moreover, a fourth field effect transistor 152*d* is connected to a second fluid actuator 154*b*. Accordingly, the fourth field effect transistor 152*d* may be considered a second set of field effect transistors including a single field effect transistor.

As shown, the first fluid actuator 154*a* is disposed in a first fluid chamber 156*a*, where the first fluid chamber 156*a* is fluidically coupled to a first nozzle 158*a*, and the first fluid chamber 156*a* has a first chamber volume. The second fluid actuator 154*b* is disposed in a second fluid chamber 156*b*, where the second fluid chamber 156*b* is fluidically coupled to a second nozzle 158*b*, and the second fluid chamber 156*b* may have a second chamber volume. In some examples chamber volumes of respective fluid chambers in which fluid actuators may be disposed may be different. In the example provided in FIG. 4, the first chamber volume may be greater than the second chamber volume.

Furthermore, the first nozzle 158*a* may have a first nozzle orifice size, and the second nozzle 158*b* may have a second nozzle orifice size. In some examples, the nozzle orifice size of respective nozzles of a fluidic die may be different. In this example, the first nozzle orifice size may be greater than the second nozzle orifice size. In addition, in some examples the fluid actuator size of respective fluid actuators of a fluidic die may be different. For the example die 150 provided in FIG. 4, it may be noted that a fluid actuator size of the first fluid actuator 154*a* may be greater than a fluid actuator size of the second fluid actuator 154*b*. Accordingly, the first fluid actuator 154*a* may be a first type of fluid actuator, and the second fluid actuator 154*b* may be a second type of fluid actuator. In this example, the distinction between the fluid actuator types may correspond to fluid actuator size. As a further clarification, the distinction between fluid actuator types may correspond to a fluid drop size which the fluid actuator may cause responsive to actuation of the fluid actuator.

Accordingly, the example die 150 includes the first fluid actuator 154*a*, the first fluid chamber 156*a*, and the first nozzle 158*a* that may be collectively referred to as a first drop generator. The die 150 also includes the second fluid actuator 154*b*, the second fluid chamber 156*b*, and the second nozzle 158*b* that may be collectively referred to as a second drop generator. In this example, the first drop generator may correspond to a first fluid drop size, and the second drop generator may correspond to a second fluid drop size, where the two fluid drop sizes are different.

In particular, the first nozzle 158*a* may have a noncircular nozzle orifice that is designed to facilitate ejection of large size fluid drops (e.g., approximately 5 pL to approximately 10 pL drop volumes, approximately 5 ng to approximately 10 ng drop masses). Therefore, the first chamber volume of the first fluid chamber 156*a* may be configured to facilitate ejection of the large fluid drop size. In turn, the first fluid actuator 154*a* may have a fluid actuator size and operating parameters that also correspond to ejection of such large fluid drop size. The second nozzle 158*b* may have a circular nozzle orifice that is designed to facilitate ejection of smaller size fluid drops (e.g., approximately 3 pL to approximately 5 pL drop volumes, approximately 3 ng to approximately 5 ng drop masses). In turn, the second fluid actuator 154*b* may have a fluid actuator size and operating parameters that also correspond to ejection of such smaller fluid drop size. Accordingly, the operating parameters of the first fluid actuator 154*a* may correspond to the first set of field effect transistors 152*a-c* (i.e., three interconnected field effect transistors), and the operating parameters of the second fluid actuator 154*b* may correspond to the second set of field effect transistors (i.e., a single field effect transistor). Therefore, the operating parameters of the first fluid actuator 154*a* may correspond to the first set of field effect transistors 152*a-c* (i.e., three interconnected field effect transistors), and the operating parameters of the second fluid actuator 154*b* may correspond to the second set of field effect transistors (i.e., a single field effect transistor).

Figure 5:
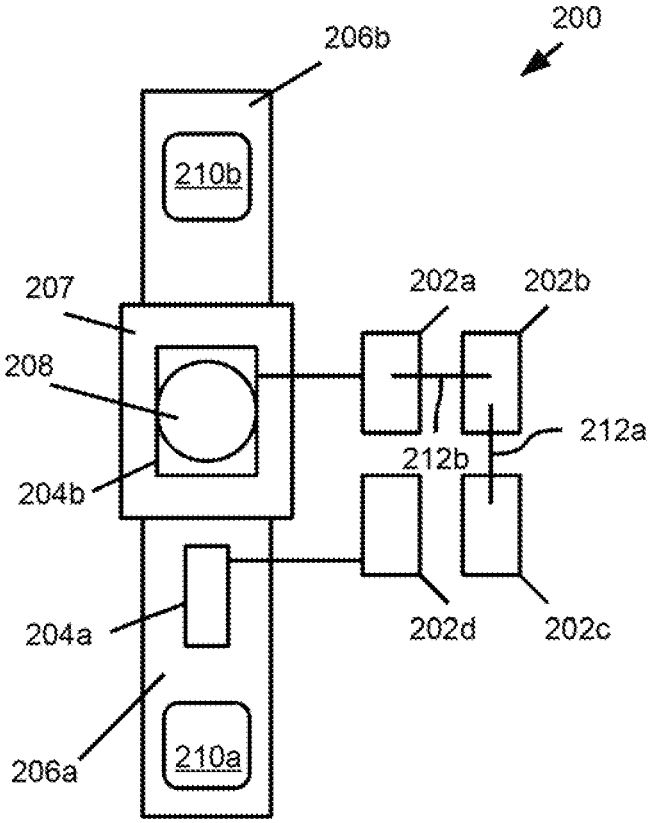
FIG. 5 is a block diagram that illustrates some components of an example fluidic die.

FIG. 5 provides a block diagram that illustrates some components of an example fluidic die 200. The fluidic die 200 comprises an array of field effect transistors 202*a-d*. The die 200 further includes fluid actuators 204*a-b*. In this example, a first actuator 204*a* is disposed in a microfluidic channel 206*a-b*. The microfluidic channel 206*a-b* is fluidically coupled to a fluid chamber 207 such that a first portion 206*a* of the microfluidic channel 206*a-b* is fluidically coupled to a first side of the fluid chamber 207 and a second portion 206*b* of the microfluidic channel 206*a-b* is fluidically coupled to a second side of the fluid chamber 207. The fluid chamber 207 is fluidically coupled to a respective nozzle 208. A second fluid actuator 204*b* is disposed in the fluid chamber 207 proximate the nozzle 208 such that actuation of the second fluid actuator 204*b* may cause ejection of a fluid drop via the nozzle 208. Accordingly, the second fluid actuator 204*b* may be referred to as a fluid ejector.

As shown, the microfluidic channel 206*a-b* is fluidically coupled to a fluid supply passage 210*a* at a first end of the microfluidic channel 206*a-b*, and the microfluidic channel 206*a-b* is fluidically coupled to a fluid collection passage 210*b* at a second end of the microfluidic channel 206*a-b*. The fluid supply passage 210*a* may supply fresh fluid to the fluid chamber 207 through the first portion 206*a* of the microfluidic channel 206*a-b*. Accordingly, the first portion 206*a* of the microfluidic channel 206*a-b* may be referred to as an upstream portion. Actuation of the first fluid actuator 204*a* may cause displacement of fluid in the microfluidic channel 206*a-b* such that fluid flows from the first portion 206*a* of the microfluidic channel 206*a-b* into the fluid chamber 207. Due to the fluid pumping into the fluid chamber 207 from the first portion 206*a* of the microfluidic channel 206*a-b*, fluid in the chamber 207 may flow into the second portion 206*b* of the microfluidic channel 206*b* and out of the fluid collection passage 210*b*. In some examples, the fluid supply passage 210*a* and the fluid collection passage 210*b* may be coupled to a common fluid supply. In other examples, the fluid supply passage 210*a* and the fluid collection passage may be coupled to fluidically separated fluid supplies.

Accordingly, in this example, the first fluid actuator 204*a* may be implemented as a fluid pump. Actuation of the first fluid actuator 204*a* may create fluid displacement and flow to thereby facilitate circulation of fluid from the fluid supply passage 210*a* to the fluid collection passage 210*b* through the fluid chamber 207. Some examples of this form of fluid circulation may be referred to as microrecirculation. Since the first fluid actuator 204*a* and the second fluid actuator 204*b* may be implemented to perform different operations, the fluid actuator size of the first fluid actuator 204*a* and the fluid actuator size of the second fluid actuator 206*a* may be different. Therefore, the first fluid actuator 204*a* and the second fluid actuator 204*b* may be connected to different numbers of field effect transistors 202*a-d*. Since the first fluid actuator 204*a* is implemented as a fluid pump, the first fluid actuator 204*a* may correspond to a first type of fluid actuator. Similarly, because the second fluid actuator 204*b* is implemented as a fluid ejector, the second fluid actuator may correspond to a second type of fluid actuator.

Specifically, in this example, a first field effect transistor 202*a*, a second field effect transistor 202*b*, and a third field effect transistor 202*c* may be interconnected via connecting members 212*a-b* to form a first set of field effect transistors 202*a-c*. The first set of field effect transistors 202*a-c* is connected to the second fluid actuator 204*b*. A fourth field effect transistor 202*d* is not connected to other field effect transistors via connecting members. Accordingly, the fourth field effect transistor 202*d* corresponds to a second set of field effect transistors having a single field effect transistor therein. As shown, the fourth field effect transistor 202*d* is connected to the first fluid actuator 204*a*. Hence, as illustrated in this example, different arrangements of field effect transistors may be interconnected via connecting members to correspond to operating parameters of fluid actuators to which the field effect transistors are connected.

Figure 6:
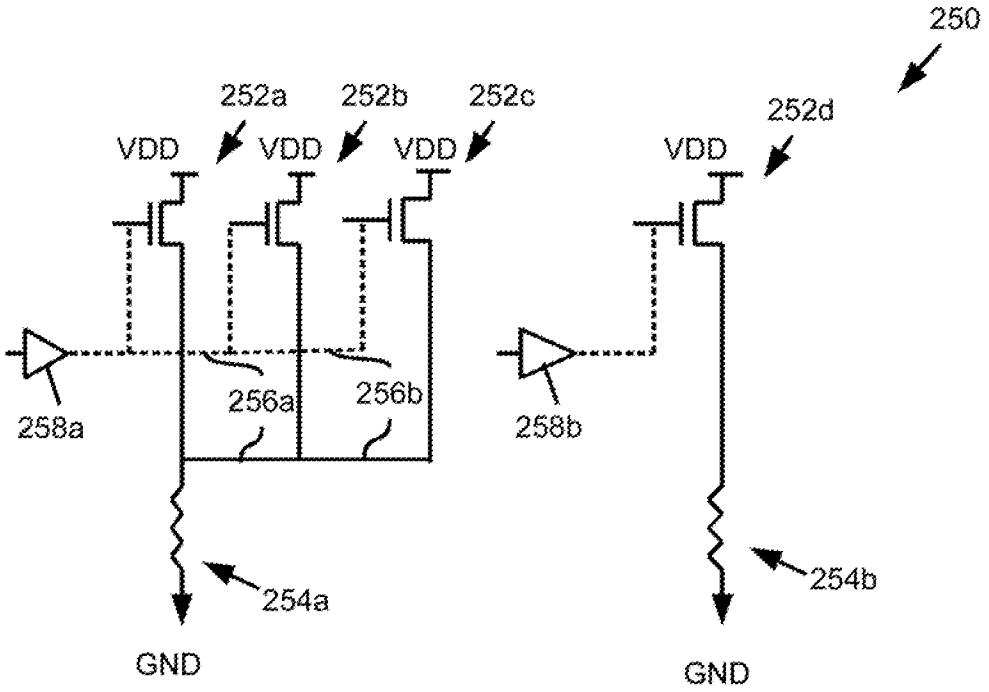
FIG. 6 is a logic diagram that illustrates some components of an example fluidic die.

FIG. 6 provides a logic diagram of some components an example fluidic die 250. In this example, the fluidic die 250 includes an array of field effect transistors 252*a-d*, and the die 250 includes fluid actuators 254*a-b*. As shown, connecting members 256*a-b* interconnect a first field effect transistor 252*a*, a second field effect transistor 252*b*, and a third field effect transistor 252*c* to form a first set of field effect transistors 252*a-c*. As shown, a first fluid actuator 254*a* is connected to the first set of field effect transistors 252*a-c*. A fourth field effect transistor 252*d* is connected to a second fluid actuator 254*b* such that the second fluid actuator 254*b* is connected to a respective set of field effect transistors that includes the fourth field effect transistor 252*d*.

In this example, a drain of each field effect transistor 252*a-d* may be coupled to a voltage source (labeled 'VPP'), and a source of each field effect transistor 252*a-d* is connected to ground (labeled 'GND') through a fluid actuator 254*a-b*. Gate drive logic 258*a-b* is coupled to a gate of each field effect transistor 252*a-d*. Notably, a respective gate drive logic 258*a-b* is coupled to the gates of each field effect transistor 252*a-d* of each respective set of field effect transistors. For example, a first gate drive logic 258*a* is connected to: a gate of the first field effect transistor 252*a*; a gate of the second field effect transistor 252*b*; and a gate of the third field effect transistor 252*c*. Accordingly, addressing the first gate drive logic 258*a* enables the gate of the first field effect transistor 252*a*, the second field effect transistor 252*b*, and the third field effect transistor 252*c*. Therefore, the field effect transistors of the first set of field effect transistors 252*a-c* operate in parallel and addressing of the first gate logic 258*a* causes actuation of the first fluid actuator 254*a*. As another example, addressing the second gate logic 258*b* enables the gate of the fourth field effect transistor 252*d*, which, in turn actuates the second fluid actuator 254*b*.

Figure 7:
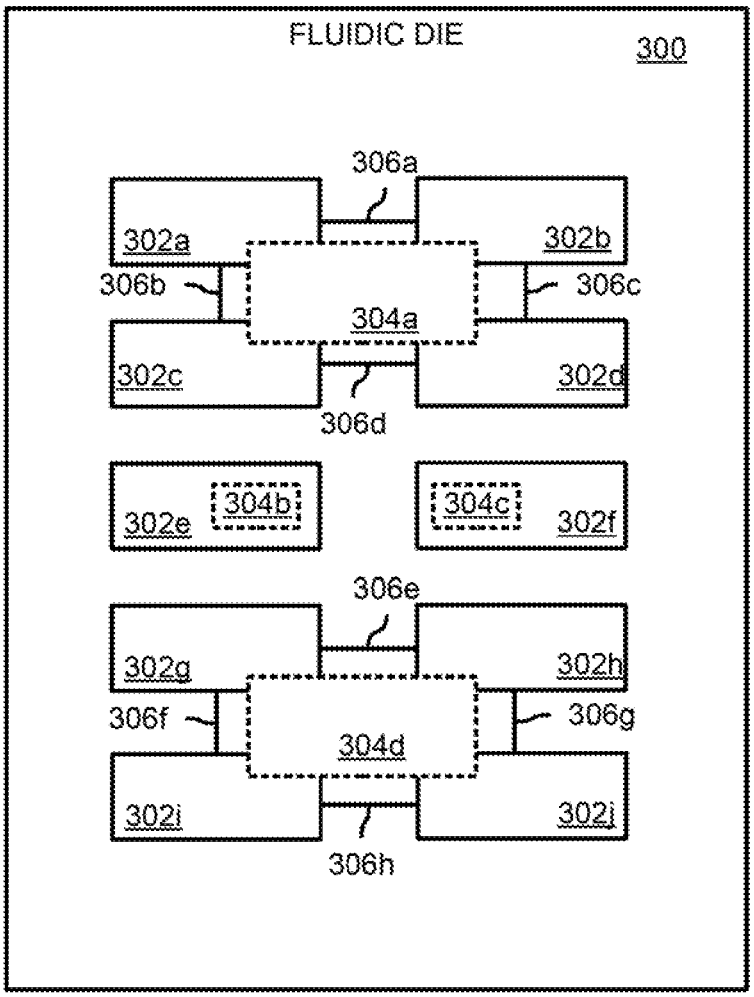
FIG. 7 is a block diagram that illustrates some components of an example fluidic die.

FIG. 7 provides a block diagram that illustrates some components of an example fluidic die 300. In this example, the fluidic die 300 includes an array of field effect transistors 302*a-j* and a plurality of fluid actuators 304*a-d*. The fluidic die 300 includes connecting members 306*a-h*. In this example, a first connecting member 306*a* connects a first field effect transistor 302*a* and a second field effect transistor 302*b*; a second connecting member 306*b* connects the first field effect transistor 302*a* and a third field effect transistor 302*c*; a third connecting member 306*c* connects the second field effect transistor 302*b* and a fourth field effect transistor 302*d*; and a fourth connecting member 306*d* connects the third field effect transistor 302*c* and the fourth field effect transistor 302*d*. Accordingly, the first field effect transistor 302*a*, the second field effect transistor 302*b*, the third field effect transistor 302*c*, and the fourth field effect transistor 302*d* are interconnected via the first connecting member 306*a*, the second connecting member 306*b*, the third connecting member 306*c*, and the fourth connecting member 306*d* to thereby form a first set of field effect transistors. The first set of field effect transistors 302*a-d* is connected to a first fluid actuator 304*a*.

A fifth field effect transistor 302*e*, which is not connected to other field effect transistors, and, accordingly, may be considered a second set of field effect transistors having a single field effect transistor, is connected to a second fluid actuator 304*b*. Similarly, a sixth field effect transistor 302*f*, which may be considered a third set of field effect transistors including a single field effect transistor, is connected to a third fluid actuator 304*c*.

In addition, a fifth connecting member 306*e* connects a seventh field effect transistor 302*g* and an eighth field effect transistor 302*h*; a sixth connecting member 306*f* connects the seventh field effect transistor 302*g* and a ninth field effect transistor 302*j*; a seventh connecting member 306*g* connects the eighth field effect transistor 302*h* and a tenth field effect transistor 302*j*; and an eighth connecting member 306*h* connects the ninth field effect transistor 302*j* and the tenth field effect transistor 302*j*. Accordingly, the seventh field effect transistor 302*g*, the eighth field effect transistor 302*h*, the ninth field effect transistor 302*j*, and the tenth field effect transistor 302*i* are interconnected via the fifth connecting member 306*e*, the sixth connecting member 306*f*, the seventh connecting member 306*g*, and the eighth connecting member 306*h* to thereby form a fourth set of field effect transistors. The fourth set of field effect transistors 302*g-j* is connected to a fourth fluid actuator 304*d*.

Accordingly, in this example, different fluid actuators 304*a-d* of the fluidic die 300 may be connected to different numbers of interconnected field effect transistors 302*a-j*. Moreover, as may be noted in this example, the first fluid actuator 304*a* and the fourth fluid actuator 304*d* may correspond to a first actuator size, and the second fluid actuator 304*b* and the third fluid actuator 304*c* may correspond to a second fluid actuator size that is different than the first fluid actuator size. Due to the differences in fluid actuator sizes, the fluid actuators may have different operating parameters.

Accordingly, the number of field effect transistors 302*a-j* connected to each fluid actuator 304*a-d* may be based at least in part on the fluid actuator size. In this example, the first fluid actuator size may be greater than the second fluid actuator size. Consequently, the first fluid actuator 304*a* and fourth fluid actuator 304*d* may be connected to sets of field effect transistors having at least four interconnected field effect transistors. In contrast, the fluid actuators corresponding to the second fluid actuator size (e.g., the second fluid actuator 304*b* and the third fluid actuator 304*c*) may be connected to sets of field effect transistors having a single field effect transistor. In addition, the first fluid actuator 304*a* and the fourth fluid actuator 304*d* may be considered a first set of fluid actuators that correspond to a first type of fluid actuator, and the second fluid actuator 304*b* and the third fluid actuator 304*c* may be considered a second set of fluid actuators that correspond to a second type of fluid actuator.

Figure 8:
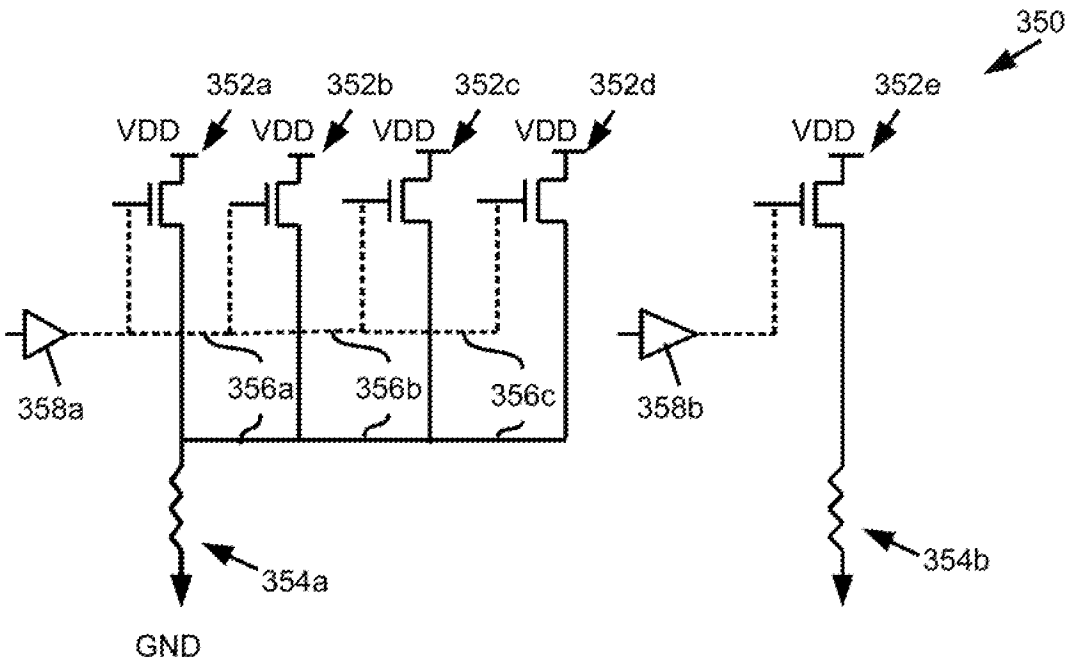
FIG. 8 is a logic diagram that illustrates some components of an example fluidic die.

FIG. 8 provides a logic diagram of some components an example fluidic die 350. In this example, the fluidic die 350 includes an array of field effect transistors 352*a-e*, and the die 350 includes fluid actuators 354*a-b*. As shown, connecting members 356*a-c* interconnect a first field effect transistor 352*a*, a second field effect transistor 352*b*, a third field effect transistor 352*c*, and a fourth field effect transistor 352*d* to form a first set of field effect transistors 352*a-d*. As shown, a first fluid actuator 354*a* is connected to the first set of field effect transistors 352*a-d*. A fifth field effect transistor 352*e* is connected to a second fluid actuator 354*b* such that the second fluid actuator 354*b* is connected to a respective set of field effect transistors that includes the fifth field effect transistor 352*e*.

In this example, a drain of each field effect transistor 352*a-e* may be coupled to a voltage source (labeled 'VPP'), and a source of each field effect transistor 352*a-e* is connected to ground (labeled 'GND') through a fluid actuator 354*a-b*. Gate drive logic 358*a-b* is coupled to a gate of each field effect transistor 352*a-e*. Notably, a respective gate drive logic 358*a-b* is coupled to the gates of each field effect transistor 352*a-e* of each respective set of field effect transistors. For example, a first gate drive logic 358*a* is connected to: a gate of the first field effect transistor 352*a*; a gate of the second field effect transistor 352*b*; a gate of the third field effect transistor 352*c*; and a gate of the fourth field effect transistor 352*d*. Accordingly, addressing the first gate drive logic 358*a* enables the gate of the first field effect transistor 352*a*, the second field effect transistor 352*b*, the third field effect transistor 352*c*, and the fourth field effect transistor 352*d*. Therefore, the field effect transistors of the first set of field effect transistors 352*a-d* operate in parallel and addressing of the first gate logic 358*a* causes actuation of the first fluid actuator 354*a*. As another example, addressing the second gate logic 358*b* enables the gate of the fifth field effect transistor 352*e*, which, in turn actuates the second fluid actuator 354*b*.

Figure 9:
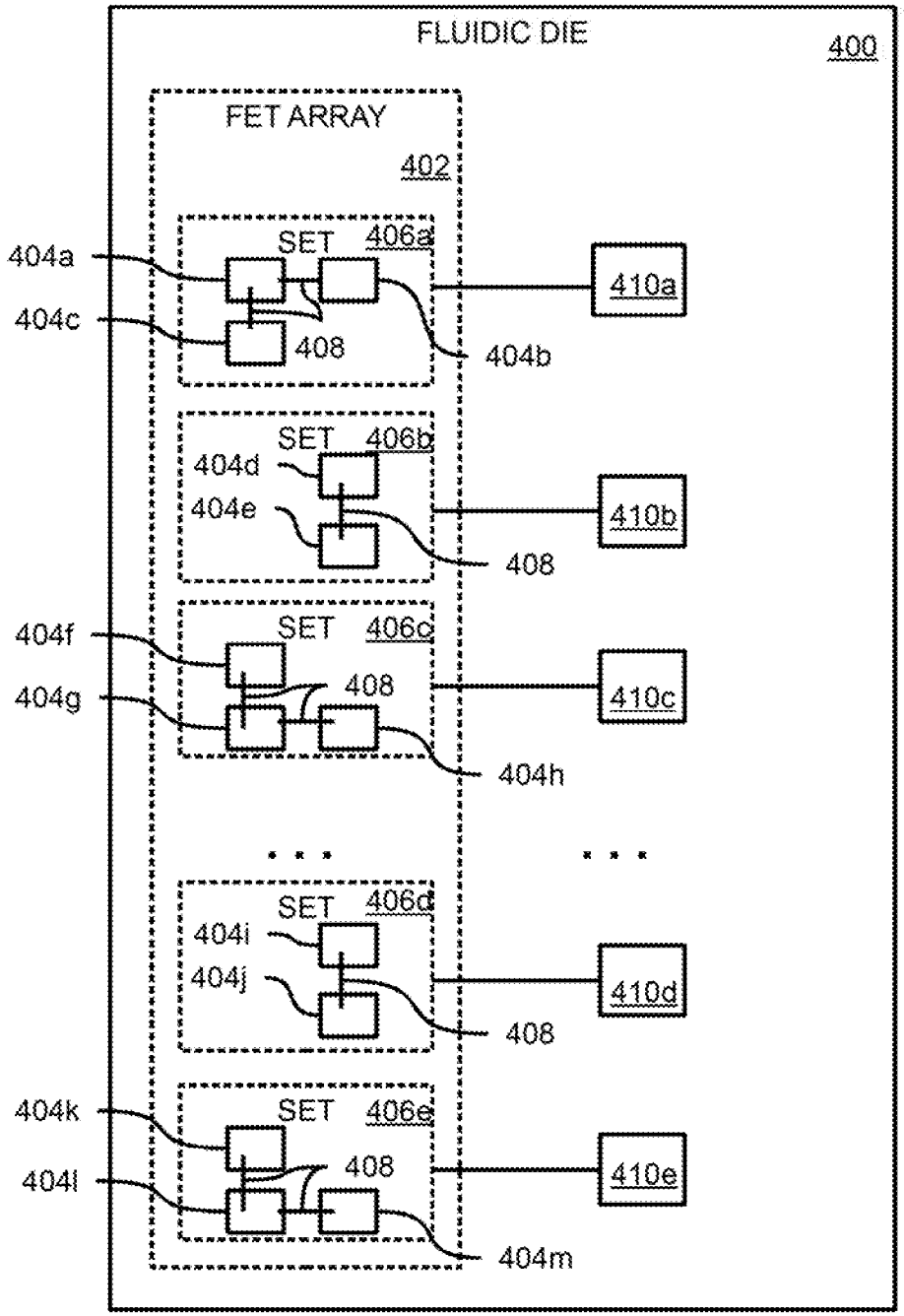
FIG. 9 is a block diagram that illustrates some components of an example fluidic die.

Turning now to FIG. 9, this figure provides a block diagram that illustrates some components of an example fluidic die 400. As shown, the fluidic die 400 includes an array of field effect transistors 402. As shown, the array 402 includes field effect transistors 404*a-m* arranged in sets 406*a-e*. In particular, different numbers of field effect transistors may be connected via connecting members 408 to form respective sets 406*a-e*. Each set 406*a-e* of field effect transistors 404*a-m* are connected to a respective fluid actuator 410*a-e*.

In this example, a first set 406*a* may include a first field effect transistor 404*a*, a second field effect transistor 404*b*, and a third field effect transistor 404*c* that are interconnected via connecting members 408. As shown, the first set 406*a* is connected to a first fluid actuator 410*a*. A second set 406*b* may include a fourth field effect transistor 404*d* and a fifth field effect transistor 404*e* that are interconnected via a connecting member 408. The second set 406*b* is connected to a second fluid actuator 410*b*. A third set 406*c* includes a sixth field effect transistor 404*f*, a seventh field effect transistor 404*g*, and an eighth field effect transistor 404*h* that are interconnected via connecting members 408. The third set 406*c* is connected to a third fluid actuator 410*c*. A fourth set 406*d* may include a ninth field effect transistor 404*i* and a tenth field effect transistor 404*j* that are interconnected via a connecting member 408. The fourth set 406*d* is connected to a fourth fluid actuator 410*d*. A fifth set 406*e* includes an 11th field effect transistor 404*k*, a 12th field effect transistor 4041, and a 13th field effect transistor 404*m* that are interconnected via connecting members 408. The fifth set 406*e* is connected to a fifth fluid actuator 410*e*.

Figure 10:
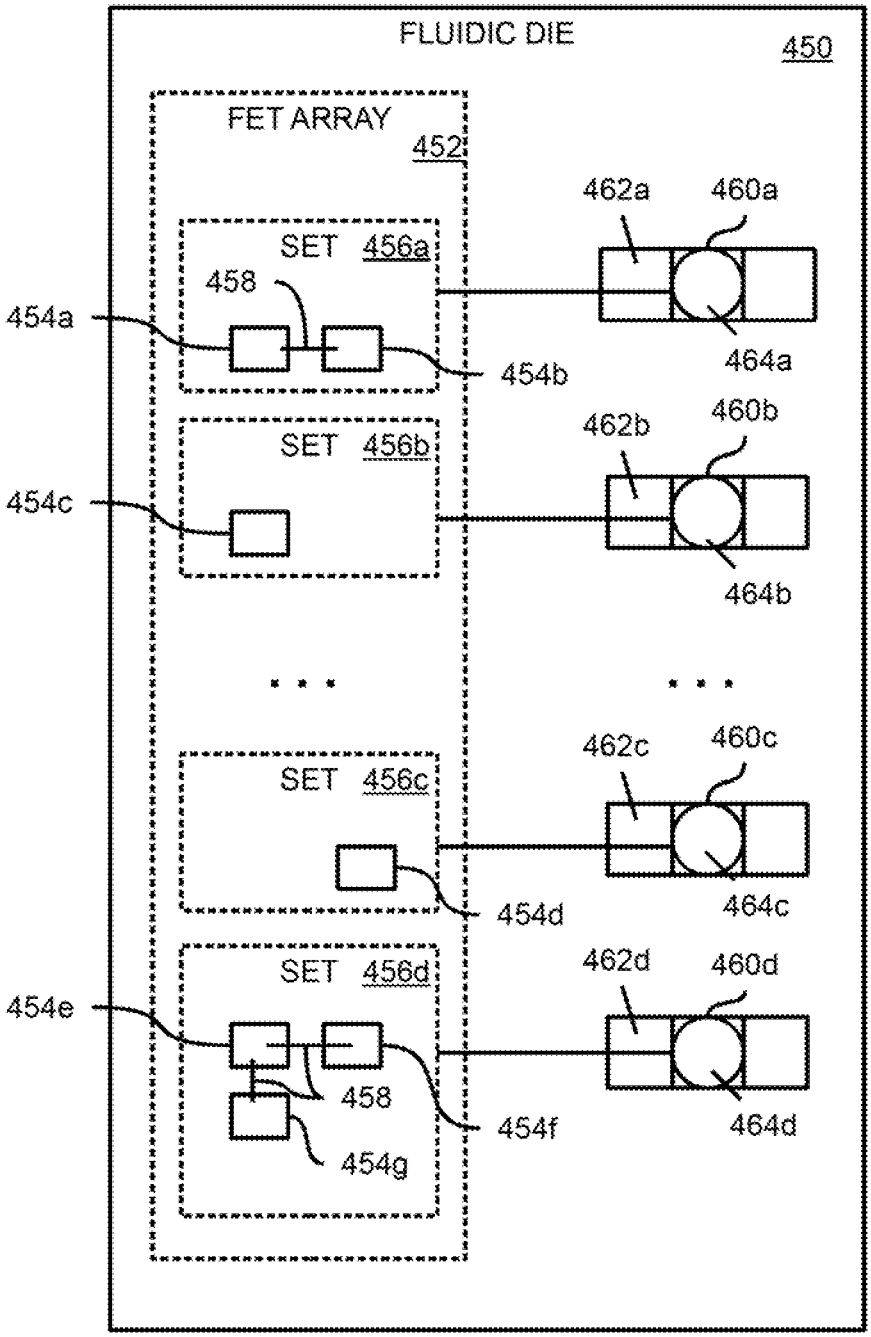
FIG. 10 is a block diagram that illustrates some components of an example fluidic die.

FIG. 10 provides a block diagram that illustrates some components of an example fluidic die 450. As shown, the fluidic die 450 includes an array of field effect transistors 452. As shown, the array 452 includes field effect transistors 454*a-g* arranged in sets 456*a-d*. Different numbers of field effect transistors may be connected via connecting members 458 to form respective sets 456*a-d*. Each set 456*a-d* of field effect transistors 454*a-g* are connected to a respective fluid actuator 460*a-d*. Each respective fluid actuator 460*a-d* may be disposed in a respective fluid chamber 462*a-d*, and each respective fluid chamber 462*a-d* may be fluidically coupled to a respective nozzle 464*a-d*.

In this example, the fluid actuators 460*a-d* of the fluidic die 450 may be coupled to different numbers of field effect transistors 454*a-g*. Accordingly, as with other examples described herein, interconnecting field effect transistors 454*a-g* into respective sets 456*a-d* with connecting members 458 may enable connecting field effect transistors 454*a-g* in parallel. With the flexible layout and configurations described herein, examples may facilitate connecting fluid actuators 460*a-d* to different numbers of field effect transistors 454*a-g* based at least in part on the implementation and/or operating parameters of the fluid actuators 460*a-d*.

Figure 11:
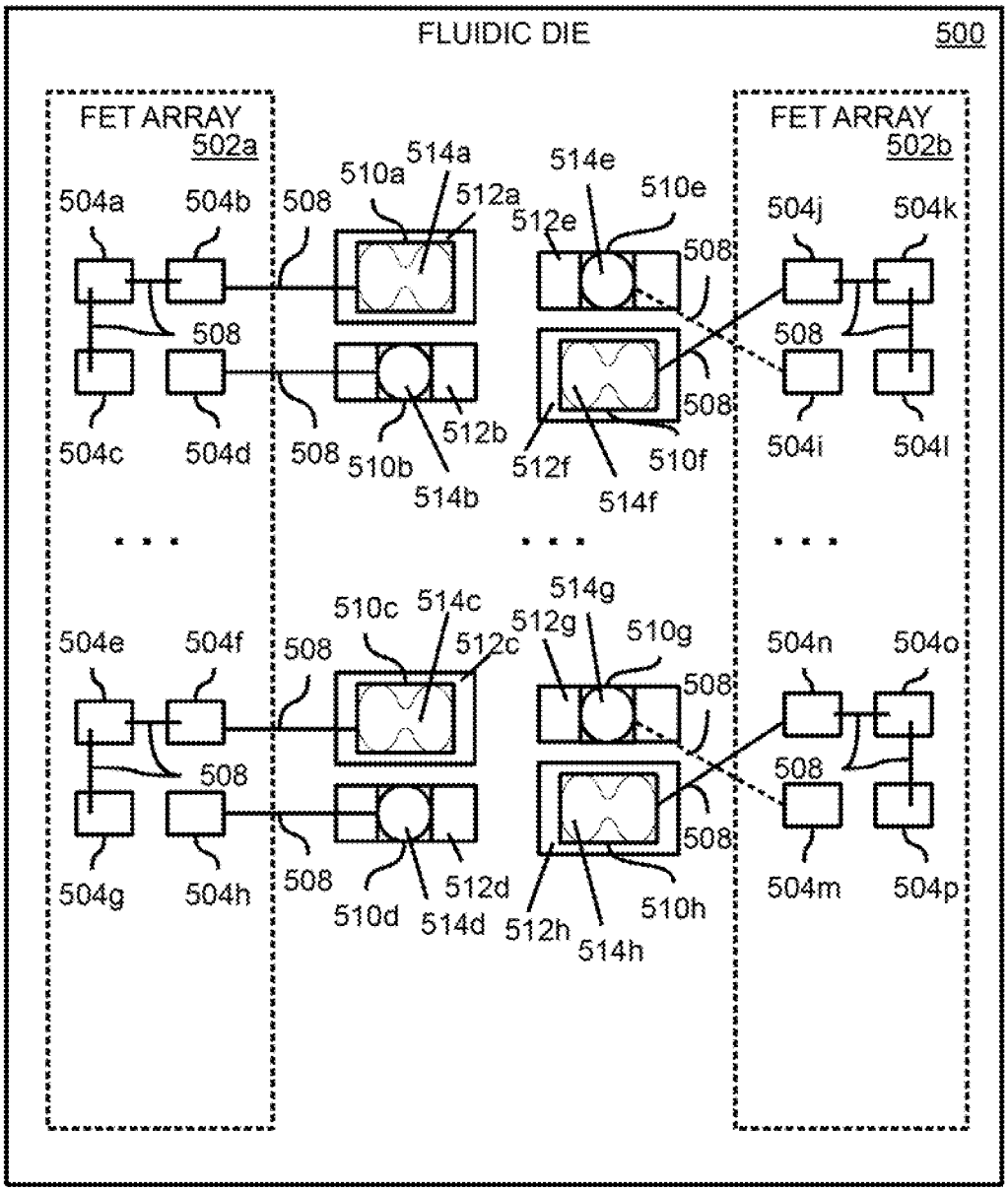
FIG. 11 is a block diagram that illustrates some components of an example fluidic die.

FIG. 11 provides a block diagram that illustrates some components of an example fluidic die 500. As shown, the fluidic die 500 includes arrays of field effect transistors 502*a-b*. As shown, the arrays 502*a-b* include field effect transistors 504*a-p*. Different numbers of field effect transistors may be interconnected via connecting members 508 to form respective sets of field effect transistors.

In this example, a first set of field effect transistors may comprise a first field effect transistor 504*a*, a second field effect transistor 504*b*, and a third field effect transistor 504*c*. The first set of field effect transistors may be connected to a first fluid actuator 510*a* via a connecting member. A second set of field effect transistors may include a fourth field effect transistor 504*d*, and the second set of field effect transistors may be connected to a second fluid actuator 510*b* via a connecting member 508. A third set of field effect transistors may include a fifth field effect transistor 504*e*, a sixth field effect transistor 504*f*, and a seventh field effect transistor 504*g*. The third set of field effect transistors may be connected to a third fluid actuator 510*c* via a connecting member. A fourth set of field effect transistors may include an eighth field effect transistor 504*h*, and the fourth set of field effect transistors may be connected to a fourth fluid actuator 510*d* via a connecting member 508. A fifth set of field effect transistors may include a ninth field effect transistor 504*i*, and the fifth set of field effect transistors may be connected to a fifth fluid actuator 510*e* via a connecting member 508. A sixth set of field effect transistors may include a tenth field effect transistor 504*j*, an 11th field effect transistor 504*k*, and a 12th field effect transistor 5041. The sixth set of field effect transistors may be connected to a sixth fluid actuator 510*f* via a connecting member 508. A seventh set of field effect transistors may include a 13th field effect transistor 504*m*, and the seventh set of field effect transistors may be connected to a seventh fluid actuator 510*g* via a connecting member 508. An eighth set of field effect transistors may include a 14th field effect transistor 504*n*, a 15th field effect transistor 504*o*, and a 16th field effect transistor 504*p*. The eighth set of field effect transistors may be connected to an eighth fluid actuator 510*h* via a connecting member 508.

Each respective fluid actuator 510*a-h* of the fluidic die may be disposed in a respective fluid chamber 512*a-h*. Each respective fluid chamber 512*a-h* may be fluidically coupled to a respective nozzle 514*a-h*. As illustrated in this example, a fluidic die similar to the example fluidic die 500 may include nozzles 514*a-h*, fluid chambers 512*a-h*, and fluid actuators 510*a-h* arranged in more than one column. For example, the first fluid actuator 510*a*, second fluid actuator 510*b*, third fluid actuator 510*c*, and fourth fluid actuator 510*d* and the corresponding fluid chambers 512*a-d* and nozzles 514*a-d* may correspond to a first column. Similarly, the fifth fluid actuator 510*e*, sixth fluid actuator 510*f*, seventh fluid actuator 510*g*, and eighth fluid actuator 510*h* may and corresponding fluid chambers 512*e-h* and nozzles 512*e-h* may correspond to a second column. The columnar arrangements of fluid actuators 510*a-h*, fluid chambers 512*a-h*, and nozzles 514*a-d* may be referred to as nozzle columns. As shown, an example fluidic die may include a respective field effect transistor array 502*a-b* for each respective nozzle column.

Therefore, the example provided in FIG. 11 illustrates a fluidic die with at least two nozzle columns and at least two arrays of field effect transistors 502*a-b*. As shown, the field effect transistors 504*a-p* of each array 502*a-b* may be configured with connecting members 508 to implement different arrangements of field effect transistors 504*a-p* that correspond to different fluid actuator arrangements. Furthermore, the arrays of field effect transistors 502*a-b* facilitate arranging and interconnecting field effect transistors 504*a-p* based at least in part on operating parameters of fluid actuators 510*a-h* to which the field effect transistors are respectively connected.

For example, the first fluid actuator 510*a* is disposed in a first fluid chamber 512*a* that is fluidically coupled to a first nozzle 514*a*. As shown, the first nozzle 514*a* may correspond to a noncircular nozzle orifice shape that may have a first nozzle orifice size that may facilitate ejection of relatively higher volume fluid drops. Accordingly, the first fluid chamber 512*a* may have a first chamber volume that corresponds to ejection of the higher volume fluid drops. In turn, the first fluid actuator 510*a* may be configured to cause displacement of an amount of fluid that corresponds to the first chamber volume and/or the higher volume fluid drops. Therefore, in this example, the first fluid actuator 510*a* is connected to the first set of field effect transistors 504*a-c* that includes at least three field effect transistors. The electrical characteristics of the interconnected field effect transistors of the first set 504*a-c* correspond to the operating parameters of the first fluid actuator 510*a*.

In contrast, the second fluid actuator 510*b* is disposed in a second fluid chamber 512*b* that is fluidically coupled to a second nozzle 514*b*. As shown, the second nozzle 514*b* may correspond to a circular nozzle orifice shape that may have a second nozzle orifice size that may facilitate ejection of relatively lower volume fluid drops (as compared to the first nozzle 514*a*). Hence, the first nozzle orifice size may be greater than the second nozzle orifice size. The second fluid chamber 512*b* may have a second chamber volume that corresponds to ejection of the lower volume fluid drops, such that the second chamber volume may be less than the first chamber volume. In turn, the second fluid actuator 510*b* may be configured to cause displacement of an amount of fluid that corresponds to the second chamber volume and/or the lower volume fluid drops. Therefore, in this example, the second fluid actuator 510*b* is connected to the second set of field effect transistors 504*d* that includes a single field effect transistor. The electrical characteristics of the single field effect transistor of the second set corresponds to the operating parameters of the second fluid actuator 510*b*.

As may be further noted in this example, the second array of field effect transistors 502*b* includes a similar arrangement of field effect transistors 504*j-p* as compared to the first array of field effect transistors 502*a*. However, the arrangement of fluid actuators 510*e-h* of the second column differs from the arrangement of fluid actuators 510*a-d* of the first column. As shown, the connecting members 508 connecting the respective sets of field effect transistors 504*i-p* to the respective fluid actuators 510*e-h* may facilitate flexibility in connecting the field effect transistors and fluid actuators. In particular, the connecting members 508 may overlap, while being electrically separated by an insulator.

Figure 12:
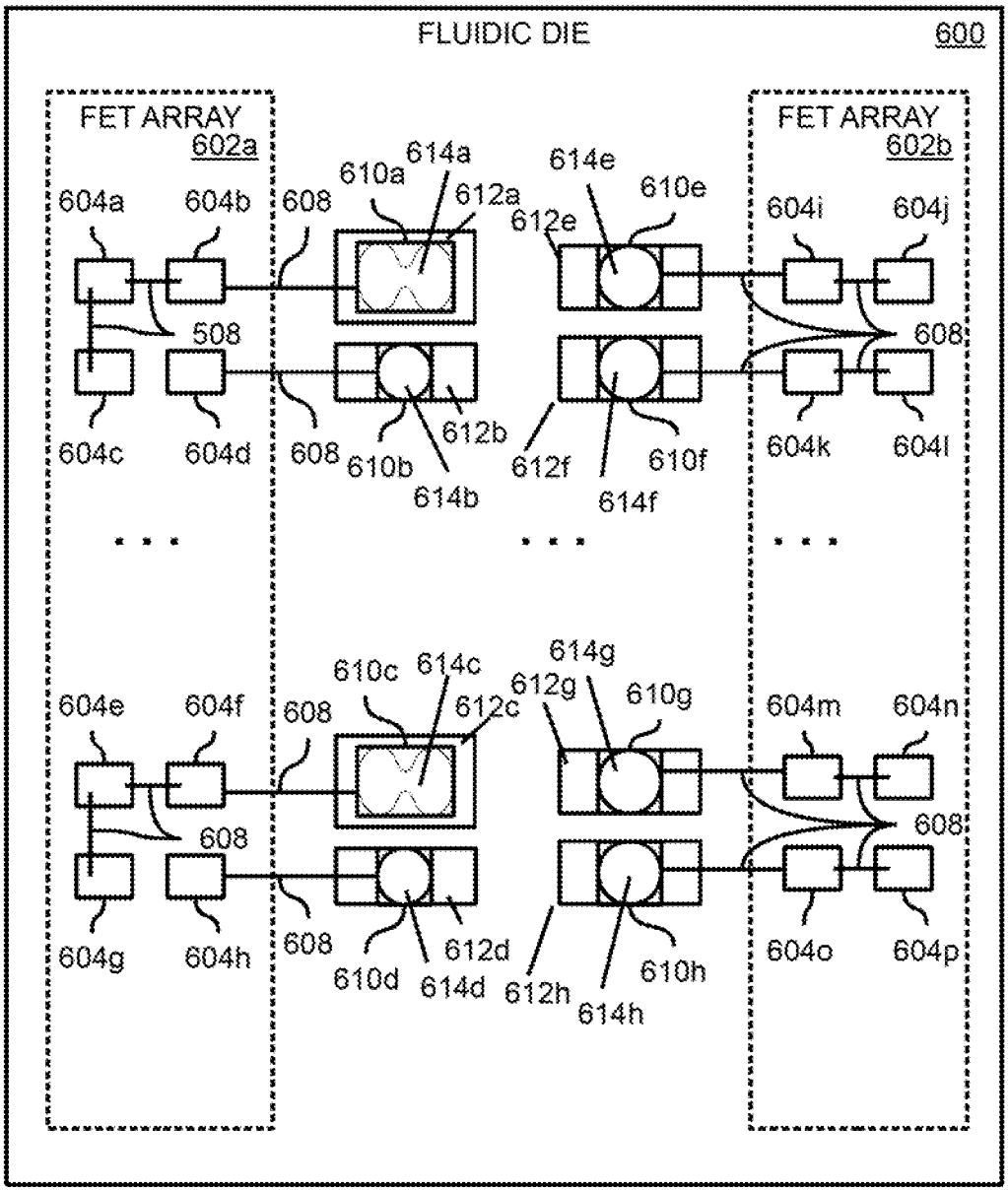
FIG. 12 is a block diagram that illustrates some components of an example fluidic die.

FIG. 12 provides a block diagram that illustrates some components of an example fluidic die 600. As shown, the fluidic die 600 includes arrays of field effect transistors 602*a-b*. As shown, the arrays 602*a-b* include field effect transistors 604*a-p*. Different numbers of field effect transistors 608*a-p* may be interconnected via connecting members 608 to form respective sets of field effect transistors.

In this example, a first set of field effect transistors may comprise a first field effect transistor 604*a*, a second field effect transistor 604*b*, and a third field effect transistor 604*c*. The first set of field effect transistors may be connected to a first fluid actuator 610*a* via a connecting member 608. A second set of field effect transistors may include a fourth field effect transistor 604*d*, and the second set of field effect transistors may be connected to a second fluid actuator 610*b* via a connecting member 608. A third set of field effect transistors may include a fifth field effect transistor 604*e*, a sixth field effect transistor 604*f*, and a seventh field effect transistor 604*g*. The third set of field effect transistors may be connected to a third fluid actuator 610*c* via a connecting member 608. A fourth set of field effect transistors may include an eighth field effect transistor 604*h*, and the fourth set of field effect transistors may be connected to a fourth fluid actuator 610*d* via a connecting member 608. A fifth set of field effect transistors may include a ninth field effect transistor 604*i* and a tenth field effect transistor 604*k*. The fifth set of field effect transistors may be connected to a fifth fluid actuator 610*e* via a connecting member 608. A sixth set of field effect transistors may include an 11th field effect transistor 604*k* and a 12th field effect transistor 6041. The sixth set of field effect transistors may be connected to a sixth fluid actuator 610*f* via a connecting member 608. A seventh set of field effect transistors may include a 13th field effect transistor 604*m* and a 14th field effect transistor 604*n*. The seventh set of field effect transistors may be connected to a seventh fluid actuator 610*g* via a connecting member 608. An eighth set of field effect transistors may include a 15th field effect transistor 604*o* and a 16th field effect transistor 604*p*. The eighth set of field effect transistors may be connected to an eighth fluid actuator 610*h* via a connecting member 808.

Each respective fluid actuator 610*a-h* of the fluidic die may be disposed in a respective fluid chamber 612*a-h*. Each respective fluid chamber 612*a-h* may be fluidically coupled to a respective nozzle 614*a-h*. The columnar arrangements of fluid actuators 610*a-h*, fluid chambers 612*a-h*, and nozzles 614*a-d* may be referred to as nozzle columns. Accordingly, this example fluidic die includes at least two nozzle columns. Other examples may include more nozzle columns. Similarly, the example fluidic die may include a respective field effect transistor array 602*a-b* for each respective nozzle column. Accordingly, while this example includes two arrays 602*a-b*, other examples may include more.

Similar to other examples provided herein, the field effect transistors 604*a-p* of the fluidic die 600 may be configured with connecting members 608 to implement different arrangements of field effect transistors 604*a-p* that correspond to different fluid actuator arrangements. Furthermore, the arrays of field effect transistors 602*a-b* facilitate arranging and interconnecting field effect transistors 804*a-p* based at least in part on operating parameters of fluid actuators 610*a-h* to which the field effect transistors are respectively connected.

In this example, the first fluid actuator 610*a* is disposed in a first fluid chamber 612*a* that is fluidically coupled to a first nozzle 614*a*. As shown, the first nozzle 614*a* may correspond to a noncircular nozzle orifice shape that may have a first nozzle orifice size that may facilitate ejection of relatively higher volume fluid drops. Accordingly, the first fluid chamber 612*a* may have a first chamber volume that corresponds to ejection of fluid drops of a first drop volume. In turn, the first fluid actuator 610*a* may be a first type of fluid actuator, where the first type of fluid actuator may be configured to cause displacement of an amount of fluid that corresponds to the first chamber volume and/or the first volume fluid drops. Therefore, in this example, the first fluid actuator 610*a* is connected to the first set of field effect transistors 604*a-c* that includes at least three field effect transistors. The electrical characteristics of the interconnected field effect transistors of the first set 604*a-c* correspond to the operating parameters of the first fluid actuator 610*a*.

In contrast, the second fluid actuator 610*b* is disposed in a second fluid chamber 612*b* that is fluidically coupled to a second nozzle 614*b*. As shown, the second nozzle 614*b* may correspond to a circular nozzle orifice shape that may have a second nozzle orifice size that may facilitate ejection of fluid drops of a second drop volume, where the second drop volume may be less than the first drop volume. Hence, the first nozzle orifice size may be greater than the second nozzle orifice size. The second fluid chamber 612*b* may have a second chamber volume that corresponds to ejection of the second volume fluid drops, such that the second chamber volume may be less than the first chamber volume. In turn, the second fluid actuator 610*b* may correspond to a second type of fluid actuator, where the second type of fluid actuator may be configured to cause displacement of an amount of fluid that corresponds to the second chamber volume and/or the second volume fluid drops. Therefore, in this example, the second fluid actuator 610*b* is connected to the second set of field effect transistors 604*d* that includes a single field effect transistor. The electrical characteristics of the single field effect transistor of the second set corresponds to the operating parameters of the second fluid actuator 610*b*.

As another example, the fifth fluid actuator 610*e* is disposed in a fifth fluid chamber 612*e* that is fluidically coupled to a fifth nozzle 614*e*. As shown, the fifth nozzle 614*b* may correspond to a circular nozzle orifice shape that may have a third nozzle orifice size that may facilitate ejection of fluid drops of a third drop volume. The third drop volume may be less than the first drop volume, and the third drop volume may be greater than the second drop volume. Hence, the first nozzle orifice size may be greater than the third nozzle orifice size, and the second nozzle orifice size may be less than the third nozzle orifice size. The fifth fluid chamber 612*e* may have a third chamber volume that corresponds to ejection of the third volume fluid drops. Accordingly, the third chamber volume may be less than the first chamber volume, and the third chamber volume may be greater than the second chamber volume. In turn, the fifth fluid actuator 610*e* may correspond to a third type of fluid actuator, where the third type of fluid actuator may be configured to cause displacement of an amount of fluid that corresponds to the third chamber volume and/or the third volume fluid drops. Therefore, in this example, the fifth fluid actuator 610*e* is connected to the fifth set of field effect transistors that includes at least two interconnected field effect transistors. The electrical characteristics of the at least two interconnected field effect transistors of the fifth set correspond to the operating parameters of the fifth fluid actuator 610*e*. While the example of FIG. 12 illustrates the first type of fluid actuator and the second type of fluid actuator in a first nozzle column and the third type of fluid actuator in a second nozzle column, other examples may implement different arrangements. For example, at least three different fluid actuator types may be implemented in a single nozzle column. As another example, only a single fluid actuator type may be implemented in each nozzle column, while the example fluidic die may include at least two fluid actuator types.

Figure 13:
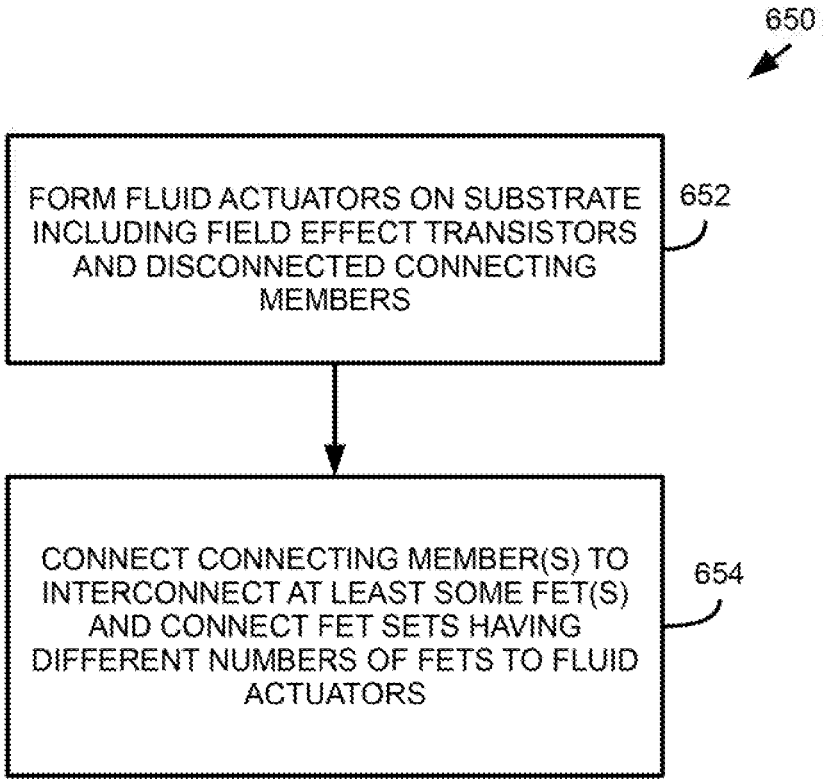
FIG. 13 is a flowchart that illustrates an example sequence of operations of an example process.

Turning now to FIG. 13, this figure provides a flowchart that illustrates an example sequence of operations of an example process 650 for a fluidic die. In this example, fluid actuators may be formed on a substrate that includes a plurality of field effect transistors and the substrate further includes disconnected connecting members (block 652). At least some connecting members of the respective groups of field effect transistors may be connected to thereby interconnect some field effect transistors of the substrate and to connect fluid actuators to respective sets of field effect transistors, where some of the respective sets of field effect transistors comprises different numbers of field effect transistors (block 654).

Figure 14:
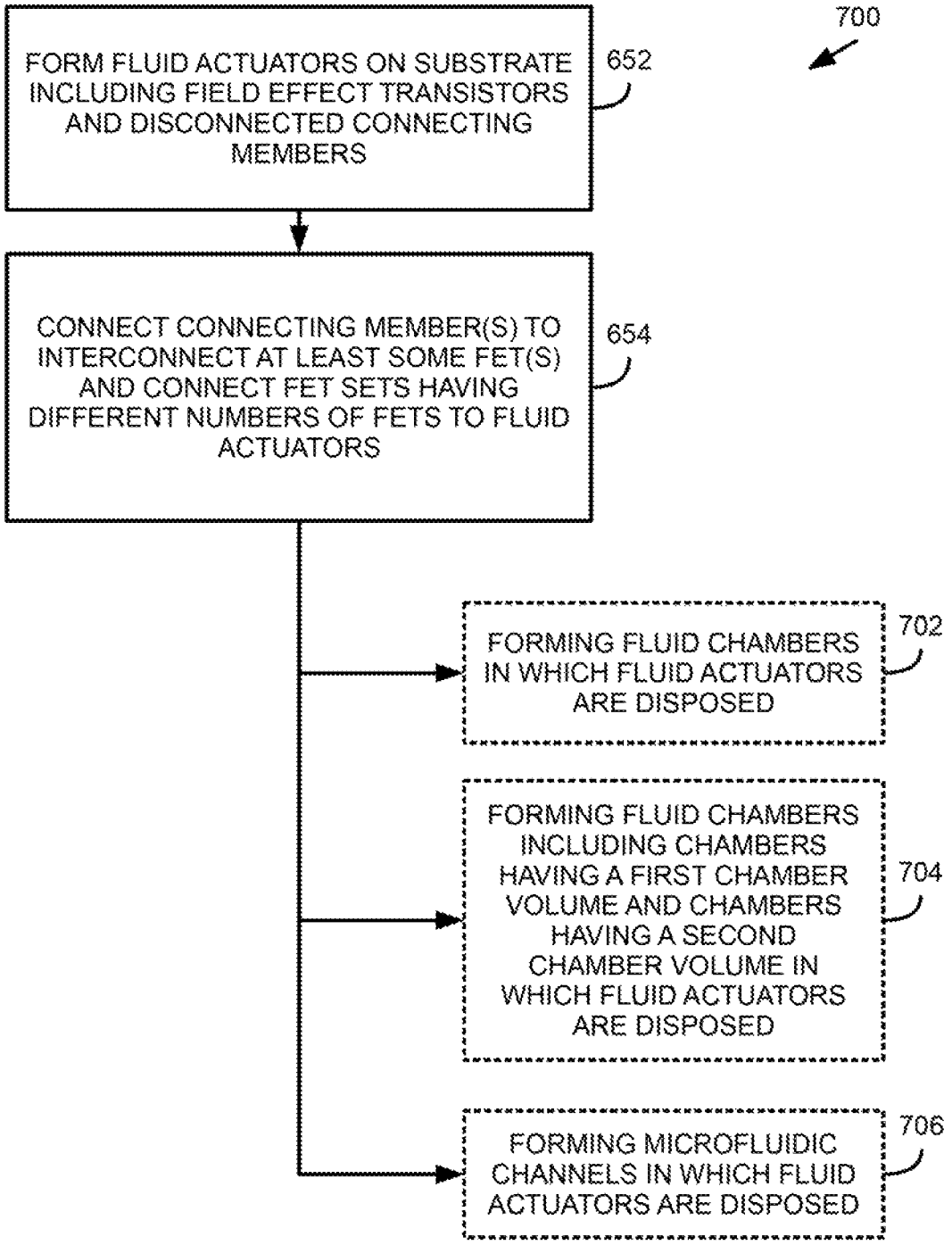
FIG. 14 is a flowchart that illustrates an example sequence of operations of an example process.

FIG. 14 provides a flowchart that illustrates an example sequence of operations of an example process 700 for a fluidic die. As described above with regard to the example process 650 of FIG. 12, the process may form fluid actuators (block 652) and connect some connecting members to interconnect some field effect transistors and to connect respective sets of field effect transistors to fluid actuators, where some of the sets of field effect transistors include different numbers of field effect transistors (block 654). Furthermore, in some example processes, fluid chambers may be formed for the fluidic die such that the fluid actuators are disposed in the fluid chambers (block 702), where the fluid chambers may include a respective set of fluid chambers having a first chamber volume and a respective set of fluid chambers having a second chamber volume (block 704). In some example processes, microfluidic channels may be formed for the fluidic die such that a respective set of the fluid actuators are disposed in the microfluidic channels (block 706).

FIGS. 15A-C provide block diagrams that illustrate some operations of an example process for a fluidic die. Referring to FIG. 15A, a substrate 800 includes a plurality of field effect transistors 802*a-h* and disconnected connecting members 804*a-r*. While the example of FIGS. 15A-C illustrates a small number of FETs 802*a-h* and one arrangement of disconnected connecting members 804*a-r*, other examples may include more or less field effect transistors and connecting members in various arrangements.

In FIG. 15A, the substrate 800 includes first through an eighth field effect transistors 802*a-h* respectively labeled with corresponding letters a-h. The substrate further includes first through 18th connecting members 804*i-r* respectively labeled with corresponding letters a-r. As shown, the field effect transistors 802*a-h* are disconnected from the connecting members In FIG. 15B, fluid actuators 806*a-d* are formed on the substrate 800. In FIG. 15C, some In FIG. 15C, some connecting members 804*a-r* have been connected to thereby interconnect some field effect transistors 802*a-h* and to connect respective sets of field effect transistors to respective fluid actuators 806*a-d*. Furthermore, in this example, some sets of field effect transistors have different numbers of field effect transistors arranged therein.

Referring to FIG. 15C, the first connecting member 804*a* and the second connecting member 804*b* are connected to thereby interconnect the first, second, and third field effect transistors 802*a-c*. A first fluid actuator 806*a* is connected to a first respective set of field effect transistors including the first, second, and third field effect transistors 082*a-c* by connecting the 11th connecting member 804*k*. A second fluid actuator 806*b* is connected to a second respective set of field effect transistors that includes the fourth field effect transistor 802*d* by connecting the 14th connecting member 804*n*. The seventh connecting member 804*g* and the eighth connecting member 804*h* are connected to thereby interconnect the fifth, sixth, and seventh field effect transistors 802*e-g*. A third fluid actuator 806*c* is connected to a third respective set of field effect transistors including the fifth, sixth, and seventh field effect transistors 802*e-g* by connecting the 15th field effect transistor 804*o*. A fourth fluid actuator 806*d* is connected to a fourth respective set of field effect transistors including the eighth field effect transistor 802*h* by connecting the 18th connecting member 804*r*. As may be noted in FIG. 15C, the first and third fluid actuators 806*a*, 806*c* may be a first type of fluid actuator (e.g. a fluid ejector, a first sized fluid actuator, etc.), and the second and fourth fluid actuators 806*b*, 806*d* may be a second type of fluid actuator that is different than the first type. Accordingly, different numbers of FETs may be connected to the different fluid actuator types.

While the examples provided herein illustrate particular arrangements and connections of field effect transistors, voltage sources, ground, and fluid actuators, other examples are not so limited. Other examples may include field effect transistors in which drains of FETs may be connected to a voltage source through a fluid actuator, and sources of the FETs may be connected to a reference (i.e., ground). In such examples, interconnected FETs may be arranged by connecting gates of the FETs and drains of the FETs via a connecting member, and the sources of the FETs may be connected to a common reference (e.g., a common ground). A fluid actuator may be connected between the voltage supply and the connected drains of the interconnected FETs. Accordingly, for this example arrangement, addressing gates of the interconnected FETs may connect the voltage source to the reference through the fluid actuator to thereby cause actuation of the fluid actuator. Other examples may include other arrangements or combinations of the arrangements described herein.

Accordingly, examples provided herein facilitate flexible arrangements of field effect transistors that may be configured based at least in part on design of fluidic dies. Field effect transistors may be connected via connecting members to thereby operate in parallel such that sets of field effect transistors may be configured with different numbers of field effect transistors based at least in part on operating parameters of fluid actuators to which the sets are connected. The preceding description has been presented to illustrate and describe examples of the principles described. This description is not intended to be exhaustive or to limit these principles to any precise form disclosed. Many modifications and variations are possible in light of the description. For example, the example fluidic dies illustrated in FIGS. 1-12 and 15A-C illustrate limited numbers of field effect transistors, fluid actuators, nozzles, fluid chambers, microfluidic channels, connecting members, etc. Examples contemplated by the description provided herein are not so limited. Some example fluidic dies may comprise hundreds or even thousands of fluid actuators on a single fluidic die. Accordingly, such examples may comprise corresponding numbers of field effect transistors, connecting members, nozzles, fluid chambers, and/or microfluidic channels. For example, some fluidic dies may comprise at least four nozzle columns, with each nozzle column having at least 400 nozzles, fluid actuators, and fluid chambers per nozzle column. In such examples, the fluidic die may comprise at least four arrays of field effect transistors comprising at least 800 field effect transistors per array.

In addition, while various examples are described herein, elements and/or combinations of elements may be combined and/or removed for various examples contemplated hereby. For example, the operations provided herein in the flowcharts of FIGS. 13 and 14 may be performed sequentially, concurrently, or in a different order. Moreover, some example operations of the flowcharts may be added to other flowcharts, and/or some example operations may be removed from flowcharts. In addition, the components illustrated in the examples of FIGS. 1-12 and 15A-C may be added and/or removed from any of the other figures in any quantities. Therefore, the foregoing examples provided in the figures and described herein should not be construed as limiting of the scope of the disclosure, which is defined in the Claims.

The invention claimed is:

1. A fluidic die comprising:

an array of field effect transistors;

connecting members interconnecting at least some of the field effect transistors of the array of field effect transistors, the field effect transistors of the array arranged into respective sets of field effect transistors;

a first fluid actuator connected to a first respective set of field effect transistors having a first number of field effect transistors; and a second fluid actuator connected to a second respective set of field effect transistors comprising a second number of field effect transistors that is different than the first number of field effect transistors, wherein the connecting members connect the field effect transistors of the second set in parallel.

2. The fluidic die of claim 1, wherein the first fluid actuator corresponds to a first fluid actuator size, and the second fluid actuator corresponds to a second fluid actuator size that is different than the first fluid actuator size.

3. The fluidic die of claim 1, further comprising:

a first fluid chamber in which the first fluid actuator is disposed, the first fluid chamber having a first chamber volume; and a second fluid chamber in which the second fluid actuator is disposed, the second fluid chamber having a second chamber volume that is different than the first chamber volume.

4. The fluidic die of claim 1, further comprising:

a microfluidic channel in which the first fluid actuator is disposed; and a fluid chamber in which the second fluid actuator is disposed, the fluid chamber fluidically coupled to the microfluidic channel, wherein the second number of field effect transistors is greater than the first number of field effect transistors.

5. The fluidic die of claim 1, wherein the first respective set of field effect transistors includes a single field effect transistor.

6. The fluidic die of claim 1, wherein the second respective set of field effect transistors includes at least three interconnected field effect transistors connected in parallel.

7. The fluidic die of claim 1, further comprising:

a first nozzle having a first nozzle orifice size;

a second nozzle having a second nozzle orifice size that is greater than the first nozzle orifice size;

a first fluid chamber in which the first fluid actuator is disposed, the first fluid chamber fluidically coupled to the first nozzle, the first fluid chamber having a first chamber volume, wherein the first respective set of field effect transistors corresponds to a single field effect transistor; and a second fluid chamber in which the second fluid actuator is disposed, the second fluid chamber fluidically coupled to the second nozzle, the second fluid chamber having a second chamber volume that is greater than the first chamber volume, wherein the second respective set of field effect transistors includes at least three field effect transistors.

8. The fluidic die of claim 1, further comprising:

a fluid inlet passage;

a fluid outlet passage;

a microfluidic channel in which the first fluid actuator is disposed, the microfluidic channel fluidically coupled to the fluid supply passage at a first end, and the microfluidic channel fluidically coupled to the fluid collection passage at a second end;

a nozzle; and a fluid chamber in which the second fluid actuator is disposed, the fluid chamber fluidically coupled to the nozzle and the microfluidic channel.

9. The fluidic die of claim 1, wherein the first respective set of field effect transistors consists of a single field effect transistor.

10. The fluidic die of claim 1, further comprising a third fluid actuator connected to a third respective set of field effect transistors, wherein the first, second and third sets of field effect transistors all include a different number of transistors and where any set with multiple transistors includes connecting members connecting the multiple transistors in parallel.

11. The fluidic die of claim 1, wherein the first fluid actuator comprises a first nozzle with a first orifice of a first size and the second fluid actuator comprises a second nozzle with a second orifice of a second size different from the first size.

12. The fluidic die of claim 11, wherein the second orifice of the second nozzle is noncircular.

13. The fluidic die of claim 1, wherein the second fluid actuator comprises a fluid pump and is disposed in a micro-recirculation system to recirculate fluid within the fluidic die.

14. A fluidic die comprising:

an array of field effect transistors;

a plurality of connecting members, the plurality of connecting members including respective connecting members interconnecting at least some field effect transistors of the array of field effect transistors; and a plurality of fluid actuators, the plurality of fluid actuators including a first type of fluid actuator and a second type of fluid actuator, each fluid actuator of the first type connected to a respective first set of field effect transistors including at least one field effect transistor, and each fluid actuator of the second type is connected to a respective second set of field effect transistors including at least one more field effect transistor than the respective first sets of field effect transistors;

wherein the first fluid actuator corresponds to a first fluid actuator size, and the second fluid actuator corresponds to a second fluid actuator size that is different than the first fluid actuator size.

15. The fluidic die of claim 14, wherein the array of field effect transistors is a first array of field effect transistors, the fluidic die further comprising:

a second array of field effect transistors, wherein the plurality of connecting members includes respective connecting members interconnecting sets of field effect transistors of the second array of field effect transistors; and wherein the plurality of fluid actuators includes a third type of fluid actuator, each respective fluid actuator of the third type is connected to a respective third set of field effect transistors of the second array of field effect transistors, and each respective third set of field effect transistors includes a number of field effect transistors that is different than a number of field effect transistors of the respective first sets of field effect transistors.

16. A process for a fluidic die comprising:

forming fluid actuators on a substrate that includes a plurality of field effect transistors and disconnected connecting members;

connecting some connecting members to thereby interconnect at least some field effect transistors and to connect respective sets of field effect transistors having different numbers of field effect transistors to the fluid actuators.

17. The process of claim 16, further comprising:

forming fluid chambers for the fluidic die such that the fluid actuators are disposed in the fluid chambers, the fluid chambers including a first set of fluid chambers having a first chamber volume, and the fluid chambers including a second set of fluid chambers having a second chamber volume, wherein, the fluid actuators disposed in the first set of fluid chambers are connected to sets of field effect transistors having a first number of interconnected field effect transistors, and the fluid actuators disposed in the second set of fluid chambers are connected to sets of field effect transistors having a second number of interconnected field effect transistors that is greater than the first number of interconnected field effect transistors.

18. The process of claim 16, further comprising:

forming fluid chambers for the fluidic die such that a first set of the fluid actuators are disposed in the fluid chambers; and forming microfluidic channels for the fluidic die such that a second set of fluid actuators are disposed in the microfluidic channels;

wherein the first set of fluid actuators are connected to sets of field effect transistors having a first number of interconnected field effect transistors, and the second set of fluid actuators are connected to sets of field effect transistors having a second number of interconnected field effect transistors that is less than the first number of interconnected field effect transistors.

19. The process of claim 16, wherein a first set of fluid actuators includes respective fluid actuators connected to respective sets of field effect transistors having a single field effect transistor.

20. The process of claim 19, wherein a second set of fluid actuators includes respective fluid actuators connected to respective sets of field effect transistors having at least two interconnected field effect transistors.

* * * * *